US011173682B2

(12) United States Patent
Musso et al.

(10) Patent No.: US 11,173,682 B2
(45) Date of Patent: Nov. 16, 2021

(54) AUTOMATIC DOOR SEQUENCING FOR DISCHARGING REFUSE FROM MULTI-COMPARTMENT PACKER

(71) Applicant: Air-Flo Manufacturing Co., Inc., Elmira Heights, NY (US)

(72) Inventors: Tom W. Musso, Bath, NY (US); Charles S. Musso, Jr., Corning, NY (US); Thomas Lee Price, Jr., Mentone, AL (US)

(73) Assignee: Air-Flo Manufacturing Co., Inc., Elmira Heights, NY (US)

( * ) Notice: Subject to any disclaimer, the term of this patent is extended or adjusted under 35 U.S.C. 154(b) by 113 days.

(21) Appl. No.: 16/546,910

(22) Filed: Aug. 21, 2019

(65) Prior Publication Data

US 2020/0039167 A1 Feb. 6, 2020

Related U.S. Application Data

(63) Continuation-in-part of application No. 15/645,222, filed on Jul. 10, 2017, now Pat. No. 10,752,439.

(51) Int. Cl.

| | |
|---|---|
| ***B65F 3/20*** | (2006.01) |
| ***B30B 15/32*** | (2006.01) |
| ***B65F 3/28*** | (2006.01) |
| ***B65F 3/00*** | (2006.01) |

(52) U.S. Cl.
CPC ..... *B30B 15/32* (2013.01); *B65F 3/001* (2013.01); *B65F 3/28* (2013.01)

(58) Field of Classification Search
CPC ..... B65F 3/208; B65F 3/001
See application file for complete search history.

(56) References Cited

U.S. PATENT DOCUMENTS

| | | | |
|---|---|---|---|
| 2,212,058 | A | 8/1940 | Wood |
| 3,756,438 | A | 9/1973 | Steltz |
| 4,460,307 | A | 7/1984 | Durant et al. |
| 5,123,801 | A | 6/1992 | O'Daniel |

(Continued)

FOREIGN PATENT DOCUMENTS

EP 0359083 A1 3/1990

OTHER PUBLICATIONS

European Search Report for Application No. 19191956.2-1009 dated Mar. 26, 2020; 8 pgs.

(Continued)

*Primary Examiner* — Jonathan Snelting
(74) *Attorney, Agent, or Firm* — Alix, Yale & Ristas, LLP

(57) ABSTRACT

A refuse truck body having a main compartment and at least one side compartment includes shields to close a rear opening of the compartments. A respective pushing device is provided for discharging refuse from each compartment. In a closed position, the shield is latched to the truck body by a locking device that selectively locks and unlocks each shield against its opening. A sequencing system is operatively connected between a lock for the packing unit and the actuator for closing and latching the shields, which prevents unlocking and raising the packing unit before the shields are closed and latched to the truck body. A sequencing system is operatively connected between the pushing device for a compartment and the actuator for closing and latching the shields, which prevents operation of the pushing device to discharge refuse from the compartment unless the shield for that compartment is unlatched.

15 Claims, 20 Drawing Sheets

(56) References Cited

U.S. PATENT DOCUMENTS

| | | | |
|---|---|---|---|
| 5,816,766 | A | 10/1998 | Clark |
| 7,118,320 | B2 | 10/2006 | Tomassoni |
| 2005/0220593 | A1 | 10/2005 | MacPherson |
| 2014/0348621 | A1 | 11/2014 | Brisson et al. |
| 2019/0009983 | A1 | 1/2019 | Musso et al. |

OTHER PUBLICATIONS

European Extended Search Report for Application No. 20191061.
9-1009 dated Oct. 29, 2020; 8 pgs.

AUTOMATIC DOOR SEQUENCING FOR DISCHARGING REFUSE FROM MULTI-COMPARTMENT PACKER

BACKGROUND

The present invention relates to trucks for refuse packing, and especially to the discharge of refuse from multi-compartment truck bodies.

Some communities desire the separate recycling of three kinds of materials: metals, paper goods, and organics. Truck bodies are known for providing three compartments for receiving, packing, and ejecting the three types of materials. Typically such bodies have one sump, one sweep blade and one pack blade for each of a central and two side compartments that are loaded and unloaded at the rear of the body. Whereas each compartment can be loaded simultaneously and packed simultaneously by the tailgate packing unit at a single stop of the truck, the compartments must be unloaded in sequence, at different locations within the recycling facility, while the packing unit is rotated away from the body.

To some extent during packing and certainly during unloading, the openings at the rear of the compartments must be controlled such that refuse being packed into or unloaded from one opening does not intermingle with refuse associated with another opening.

SUMMARY

In the context of a multiple-compartment refuse truck body with associated packer tailgate or unit, at least some of the compartments are provided with a shield arranged to selectively close an opening through which refuse is discharged from the compartment. A disclosed embodiment of such a shield has an upper shield segment with an upper end connected by a hinge to the truck body, and a lower shield segment connected by a hinge to the lower end of the upper shield segment. One disclosed embodiment of a segmented or composite shield has a first position for a packing mode where the lower shield segment is angulated (raised) relative to the upper shield segment, to provide a stationary guide such that the sweep and pack blade can push or pack refuse under the lower segment into the compartment. In another, dump mode of operation, both shield segments are fixed or held to the body in a substantially straight configuration with each shield locked to the body, thereby closing the outboard compartments of a three compartment truck body. When the packing unit is rotated or lifted to discharge refuse, only the center compartment is open and refuse in the outer side compartments is contained behind the closed, latched shields. After refuse has been discharged from the center compartment, the shield for one of the side compartments can be unlatched from the truck body. In yet another, partially protected dump mode of operation, the unlatched shield for the side compartment to be emptied freely pivots on the body at the top of the compartment and is thereby passively lifted by the discharging refuse while the other shield remains locked to the body in a closed configuration. This process is repeated for the other side compartment. The disclosed composite shields include actuators such as hydraulic cylinders for moving the lower shield segment between the open packing position and the closed dumping position. The disclosed composite shields may also be provided with actuators for lifting each composite shield from the closed position to an open position during discharge of refuse from a compartment equipped with a disclosed composite shield. Powered opening of the composite shield during refuse discharge may facilitate complete emptying of the compartments associated with the composite shield.

We have found that without sufficient training and care, an operator can make mistakes while operating a multiple-compartment refuse collecting vehicle equipped with the disclosed shields. These operational mistakes are usually related to improper operation of the doors of the composite shields. The incorrect operation includes either (1) forgetting to close and latch the shields before raising the packing unit, which results in trash spilling out mistakenly when the packing unit is raised, or (2) forgetting to unlatch and open a shield before the ejector cylinder is actuated to eject trash from the corresponding compartment, which could damage the door.

It thus an object of the present invention to provide a reliable, automatic sequencing of operations for discharging refuse from a multiple-compartment truck body equipped with shield closure at a rear opening of at least some of the compartments.

According to an apparatus embodiment of the present disclosure, a refuse truck body comprises a main compartment and at least one side compartment, with each compartment having a rear opening extending from a roof edge to a floor edge at the rear of the truck body. A respective pushing device is provided for discharging refuse from each compartment. An elongated shield is situated for the opening of each side compartment. A respective locking device selectively locks and unlocks each shield against its opening. A sequencing system is operatively connected between a lock for the packing unit and the actuator for closing and latching the shields, which prevents unlocking and raising the packing unit before the shields are closed and latched to the truck body. According to a further aspect of the disclosure, a sequencing system is operatively connected between the pushing device for a compartment and the actuator for closing and latching the shields, which prevents operation of the pushing device to discharge refuse from the compartment unless the shield for that compartment is unlatched. A refuse collecting vehicle can be equipped with both of the disclosed sequencing systems or only one of the disclosed sequencing systems. In one embodiment, the sequencing system may be controlled hydraulically by hydraulic sequence valves in cooperation with hydraulic actuators for each lower shield segment. In another embodiment, the sequencing system may be controlled electronically via a control box including a microcontroller configured to receive inputs from sensors.

According to a method embodiment, with the packing unit in a packing position, a lower shield segment is held in a fixed position whereby an operator deposits refuse in the packing unit and the packing unit packs the refuse under the lower shield segment and into the compartment. With the packing unit in an unloading position pivoted away from the compartments, the shields unlocked and freely pivotable relative to the compartments, a pushing device within the body discharges compacted refuse, which moves the shield to an open position allowing refuse to be discharged from the compartment. Sensors determine whether the packing unit is in the packing or unloading position and sensors also determine whether the shield is in a fixed (locked/latched) or freely pivotable condition. A sequencing logic system is operatively connected to the sensors whereby based on the signals, the pushing device is actuated only if the shield is in the freely pivotable condition and only when the packing unit is in the unloading position.

DETAILED DESCRIPTION

Figure 1:
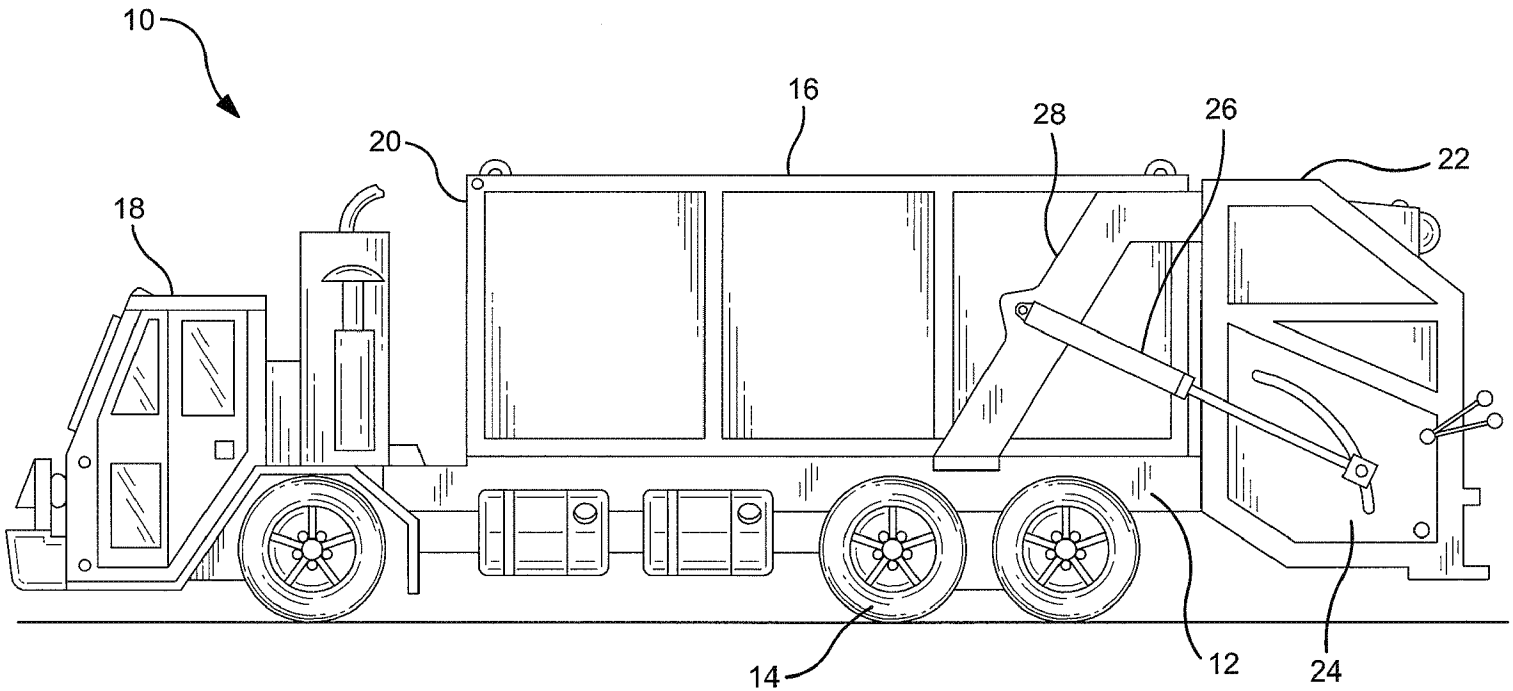
Fig. 1 PRIOR ART
FIG. 1 shows a conventional single compartment, rear-loading garbage packing truck.
Figure 8:
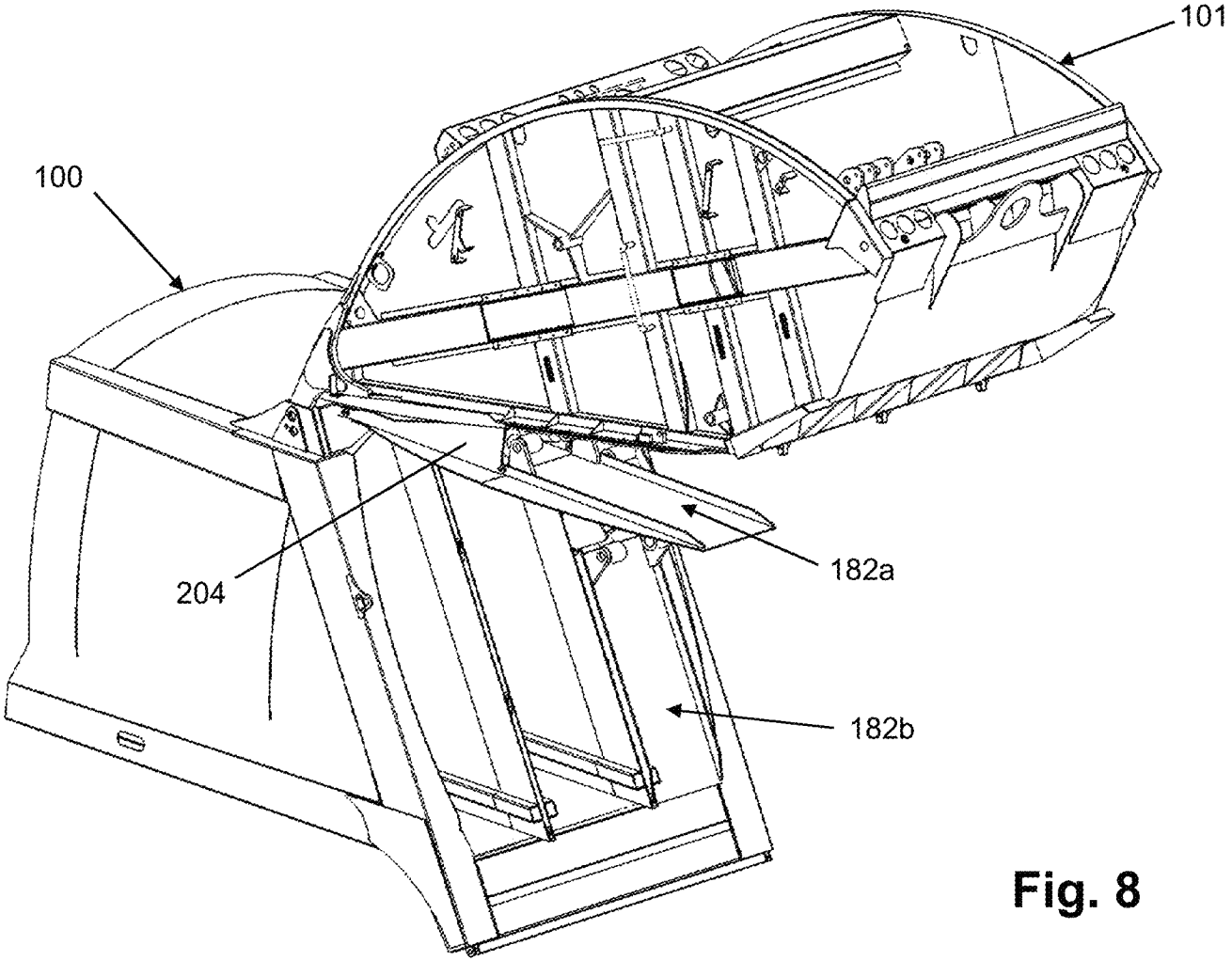
FIG. 8 shows the packing unit lifted away from the body, the center compartment having been unloaded, with one side compartment closed and the other side compartment opened for unloading.

FIG. 1 shows a conventional single compartment, rear-loading garbage truck 10, including chassis 12, wheels 14, body 16, and cab 18. The body 16 16 extends longitudinally from a front end 20 to a back end 22, where a packing unit 24 is integral with the body or supported by the chassis or both the body and chassis. Hydraulic cylinders 26 are mounted to the body or other support structure 28 to operate the packing unit 24. It is known for the packing unit 24 to be attached to the body 16 by a hinged connection at the top rear edge of the body 16, which permits the packing unit 24 to be pivoted to an open position as shown in FIG. 8. Raising the packing unit 24 allows refuse compacted in the compartment to be discharged through an opening at the back end 22 of the body 16. Prior art packing units 24 included plates on a side confronting the compartment opening to contain refuse being compacted in the compartment. When the packing unit is raised to permit discharge of compacted refuse, the compartment opening at the back end 22 of the body 16 is opened, with some refuse typically spilling out of the compartment before the process of discharging the compacted refuse begins.

Figure 2:
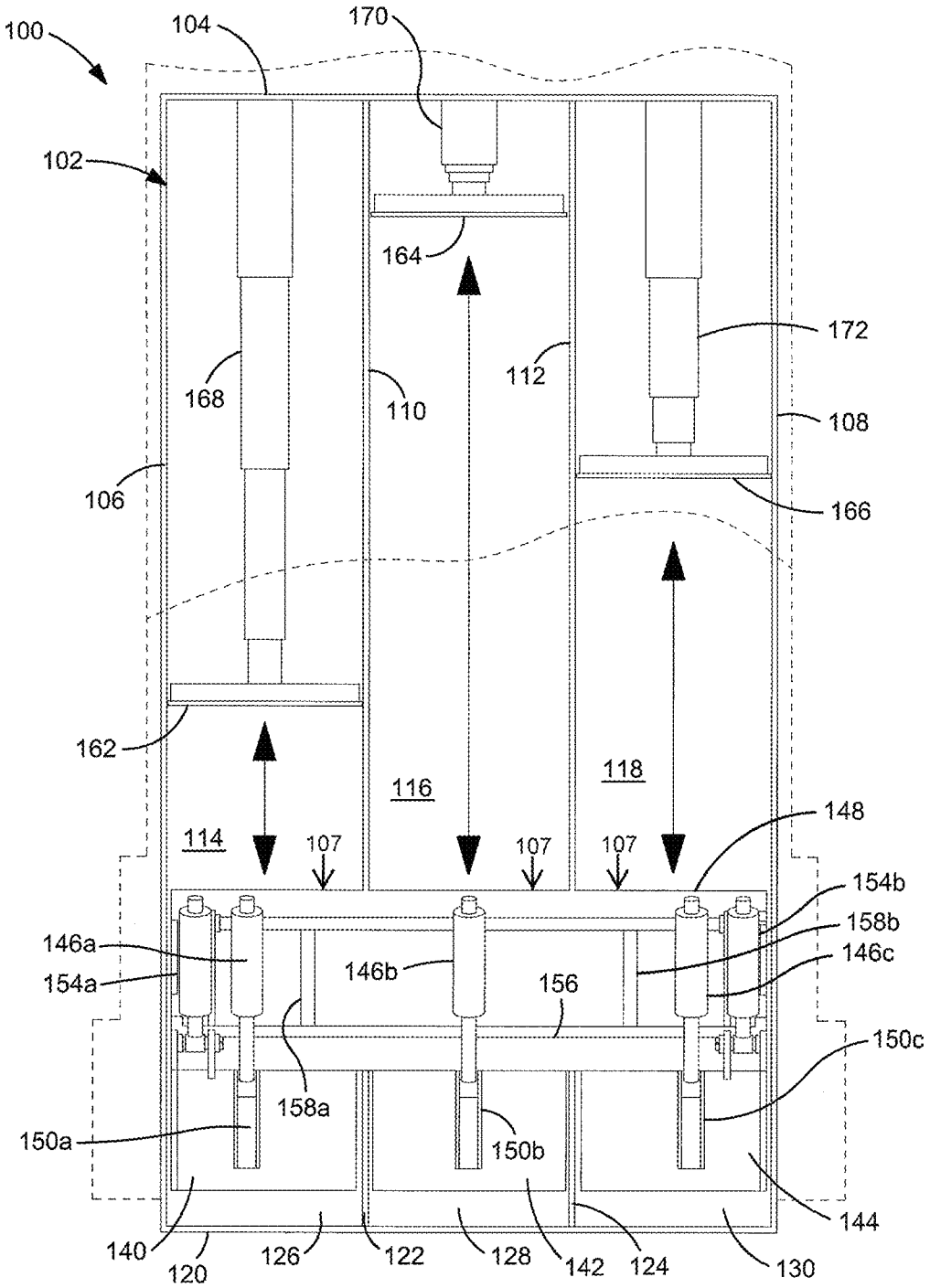
FIG. 2 is a top view of a rear loading three compartment truck body and associated packing unit with the roof removed to show internal components.
Figure 3:
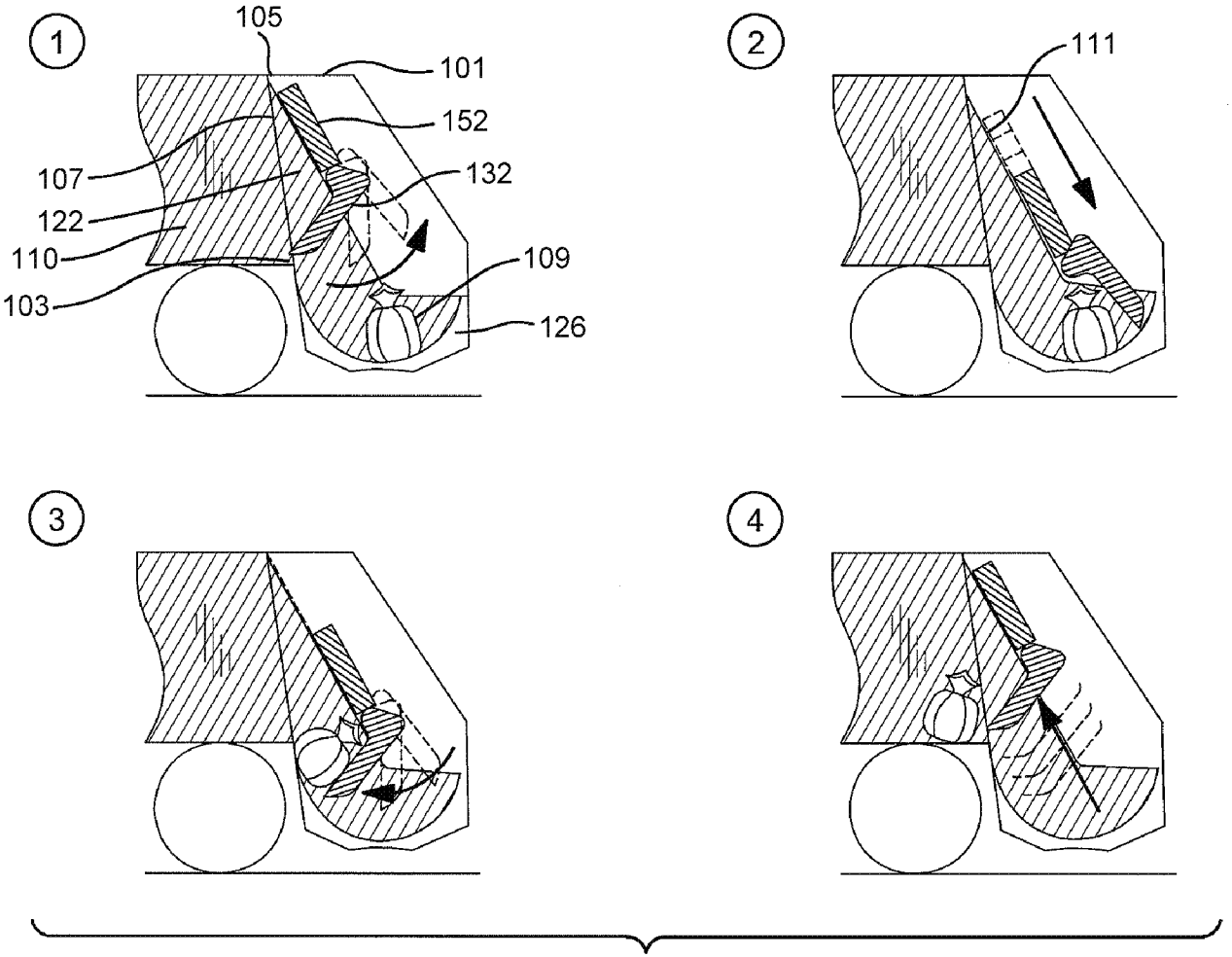
FIG. 3 is a schematic representation of the steps in a packing cycle of the packing unit of FIG. 2 according to the present invention.

FIG. 2 shows an exemplary multi-compartment truck body 100 and packing unit 101 with the roof removed to show structures within the truck body 100 and packing unit 101. The body 100 has a frame 102 with front wall 104 and side walls 106, 108. Two laterally spaced internal walls 110, 112 cooperate with the side and front walls to define three longitudinally extending packing compartments 114, 116, 118. At the back end 120 of the truck body, two longitudinally extending, laterally spaced refuse separators 122, 124 in the packing unit 101 align with rear edges of the walls 110, 112, respectively, to define separate loading channels for segregated refuse. The refuse separators define three distinct collection sumps 126, 128, 130 in the packing unit 101. The refuse separators 122, 124, extend forwardly to abut the rear edges of walls 110, 112, when the packing unit 101 is in the loading position shown in FIG. 3 so that three separate loading channels are formed, each separate loading channel associated with a sump 126, 128, 130 and a compartment 114, 116, 118. The three refuse compartments 114, 116, 118 extend longitudinally from the front (facing the cab 18 of the refuse collecting vehicle) toward the back (adjacent the packing unit 101) of the body 100. Each compartment 114, 116, 118 has a height defined between a loading floor 103 and a ceiling 105, at a rear opening 107 (as shown in FIG. 3). Three collection sumps 126, 128, 130 are defined in the packing unit 101. The collection sumps 126, 128, 130 are situated rearward of and below the compartment openings 107, to receive different types of refuse 109. When the packing unit 101 is in a loading position as shown in FIG. 3, a rear edge of the refuse separators 122, 124, is against the divider wall 110, 112, so the segregated refuse 109 is kept separate throughout the loading process illustrated in FIG. 3.

Figure 4:
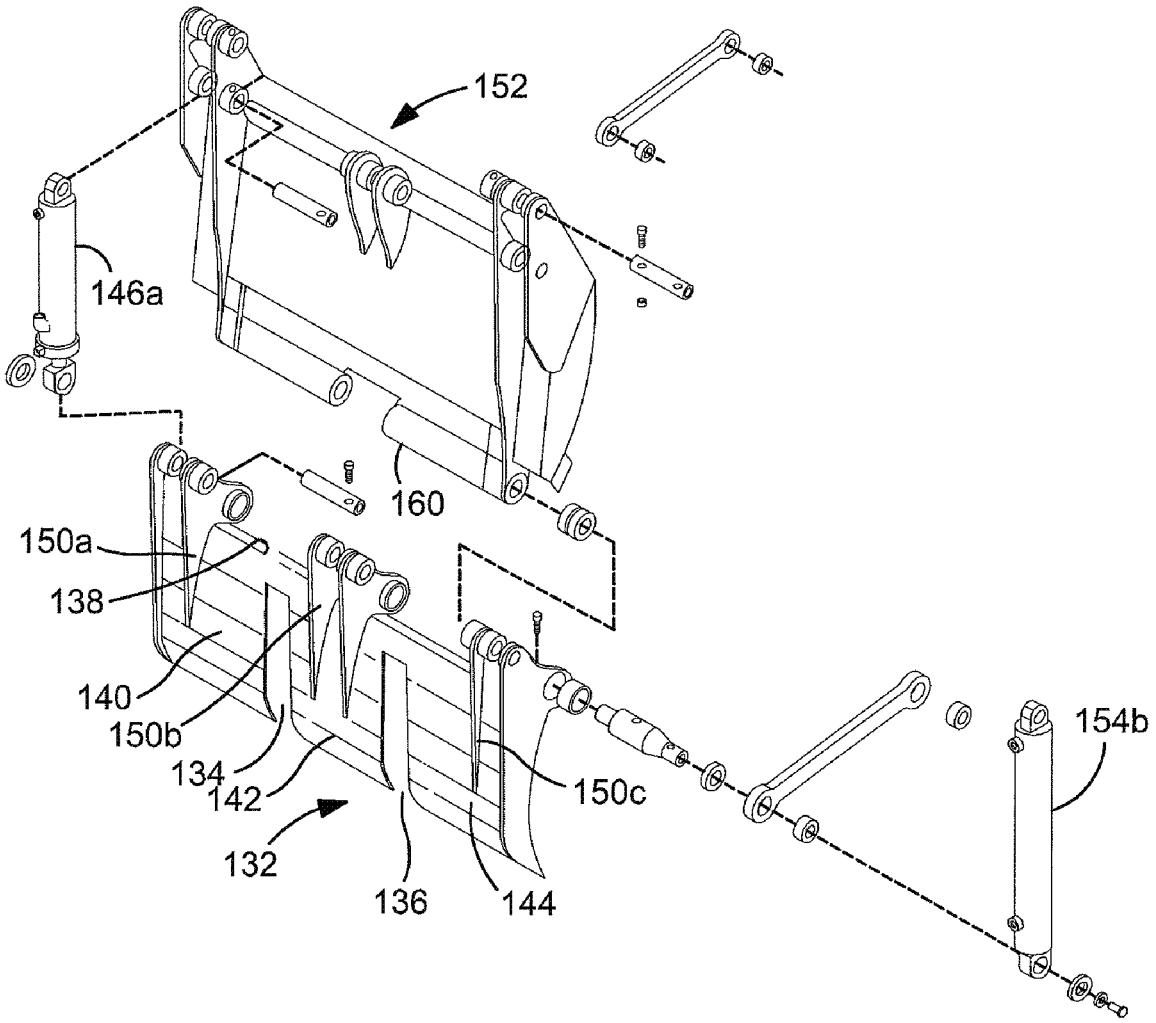
FIG. 4 is an exploded view of the preferred combination of single pack blade and segmented sweep blade according to aspects of the disclosure.

FIG. 4 is an exploded view of a sweep blade 132 and connected pack blade 152 according to aspects of the disclosure. The sweep blade 132 is connected to a lower edge of the pack blade 152 at a hinged joint 160. As shown in FIG. 2, the sweep blade 132 extends laterally across all the sumps 126, 128, 130, and has three sections 140, 142, 144 corresponding to the three collection sumps, wherein the sweep blade sections 140, 142, 144 are movable respectively within each sump 126, 128, 130. The sweep blade 132 includes two slots 134, 136 that accommodate the refuse separators 122, 124, respectively, allowing the sweep blade sections to extend to the bottom of each sump 126, 128, 130, while the refuse separators 122, 124 keep different types of refuse segregated. The sweep blade 132 illustrated in FIG. 4 is a single blade that includes slots 134, 136 and is rotated about the hinged connection 160 to the pack blade 152 by two or more hydraulic actuators 146*a*, 146*b*, 146*c* shown in FIG. 2. Alternatively, the sweep blade 132 could be constructed of separate blade segments, each connected at a hinge connection to a lower edge of the sweep blade 152. Pack blade 152 is moved in a linear path by a pair of hydraulic actuators 154*a*, 154*b* shown in FIG. 2. A packing cycle of the disclosed packing unit 101 will be described with reference to FIG. 3.

FIG. 3 is a schematic representation of four steps in a packing cycle according to the present disclosure. The packing cycle is performed by a sweep type packing unit 101 that can be incorporated into a refuse collecting vehicle having a body 100 divided into separate compartments 114, 116, 118 by divider walls 110, 112 as shown in FIG. 2. In the disclosed packing unit 101, a pack blade 152 and connected sweep blade 132 move refuse 109 from separated sumps 126, 128, 130 into the compartments 114, 116, 118. A packing cycle begins at step 1, with the pack blade 152 in a retracted (packed) position and the sweep blade 132 in a closed (swept) position. As shown in the dotted lines of step 1, the sweep blade is rotated away from the closed position to an open position, and in step 2 the pack blade 152 is moved to an extended position. With the pack blade 152 in the extended position and the sweep blade open as shown in step 2, the sweep blade 132 is positioned in the sumps 126, 128, 130 with refuse 109 between the sweep blade 132 and the openings 107 to the compartments 114, 116, 118. In step 3, the sweep blade 132 is rotated back toward the closed (swept) position, during which refuse 109 is swept from the sumps 126, 128, 130 toward the openings 107 of the compartments 114, 116, 118. In the final step, the pack blade 152 is retracted to move refuse 109 through the channels defined between refuse separators 122, 124, the openings 107, and into the compartments 114, 116, 118. The sumps 126, 128, 130 are now empty and ready to receive another load of segregated refuse 109. Retraction of hydraulic actuators (cylinders) 146*a*, 146*b*, 146*c* moves the sweep blade from the closed position to the open position as shown in step 1. Extension of hydraulic actuators (cylinders) 154*a*, 154*b* move the pack blade 152 from the retracted to the extended position as shown in step 2. Extension of hydraulic actuators 146*a*, 146*b*, 146*c* moves the sweep blade 132 from the open position to the swept position as shown in step 3. Finally, retraction of hydraulic actuators 154*a*, 154*b* moves the pack blade 152 to the retracted position as shown in step 4.

As shown in step 4 of FIG. 2, the pack blade 152 is retracted and in cooperation with the angled sweep blade 132, pushes the swept refuse 109 through the channels between refuse separators 122, 124 into compartment openings 107 while maintaining segregation of the refuse between the refuse separators 122, 124. The rearward edges 111 of refuse separators 122, 124 are positioned and inclined so that the oblique, linear movement of the pack blade 152 closely follows the edges 111 of the refuse separators 122, 124. Alternatively stated, the pack blade 152 has a lower edge that is pivotally connected along a transverse axis to an upper edge of the sweep blade 132; a first drive system 146*a*, 146*b*, 146*c* pivots the sweep blade 132 around the transverse axis, over an included angle that follows the shape of the sumps 126, 128, 130; and a second drive system 154*a*, 154*b* displaces the pack blade 152 and sweep blade 132 obliquely from the sumps 126, 128, 130 to the floors 103 of the compartments 114, 116, 118.

As shown in FIG. 4, one embodiment of a sweep blade 132 is an integral unit that extends laterally the full width of the body and has two laterally spaced slots 134, 136 which extend vertically from the bottom edge of the blade at least half way to but terminating below the top edge 138 of the blade. This defines three sweep blade sections 140, 142, 144, preferably having a length and curvature adapted to sweep within the respective three curved collection sumps 126, 128, and 130 as the slits 134, 136 pass over refuse separators 122, 124. In this manner, a different type of refuse or recyclable 109 can be placed in a different collection sump 126, 128, 130, and separately swept toward respective packer compartments 114, 116, and 118 as the respective sweep blade cylinders 146*a*, 146*b*, and 146*c* sweep the entire sweep blade 132. Three sweep blade hydraulic actuators (cylinders) 146*a*, 146*b*, 146*c* are shown but fewer can be provided. As shown in FIG. 2, the sweep blade cylinders 146*a*, 146*b*, 146*c* are supported within the frame of the packer unit 101 on cross brace 148, with linkages and associated actuation arms 150*a*, 150*b*, and 150*c* connected to the back side, for pivoting the sweep blade 132.

The pack blade 152 extends laterally across the packing unit 101 above the sweep blade 132, for oblique movement toward and away from the compartments. Pack blade cylinders 154*a*, 154*b* are shown mounted inside the body or frame of the packing unit 101 for this purpose and connect to an additional cross brace 156, but the pack blade hydraulic actuators (cylinders) 154*a*, 154*b* can alternatively be mounted outside the frame of the packing unit 101. Braces 158*a*, 158*b* are also provided between cross braces 148 and 156. The lower edge of the pack blade 152 pivotally connected at a hinged connection 160 along a transverse axis to the upper edge 138 of the sweep blade for cooperative movement as described with respect to FIG. 3. In the disclosed packing unit 101, the hydraulic actuators 146*a*, 146*b*, 146*c* for the sweep blade 132 and the hydraulic actuators 154*a*, 154*b* are mounted to the packing unit 101.

Refuse in each compartment 114, 116, 118 is packed as the pack blade 152 and sweep blade 132 sections 140, 142, 144, push the refuse 109 into the openings 107 at the rear of the compartments 114, 116, 118. The refuse 109 is pushed against packing faces 162, 164, 166 on the ejection cylinders 168, 170, 172. The cylinders 168, 170, 172 retract as the compartments 114, 116, 118 fill with packed refuse. When the truck is full, the entire packing unit 101 pivots upwardly to expose the compartment openings 107 at the rear of the body 100. The ejection cylinders 168, 170, 172 are extended to push the refuse out the back end of the truck into three different dumping stations for the respective three different kinds of refuse.

When the packing unit 101 is raised open as shown in FIG. 8 for refuse ejection from the three compartments 114, 116, 118, there is a tendency for all three compartments to start spilling refuse out the openings 107 at the rear of the body 100. This is undesirable, as the type of refuse in each compartment is different and must be offloaded separately.

Figure 5:
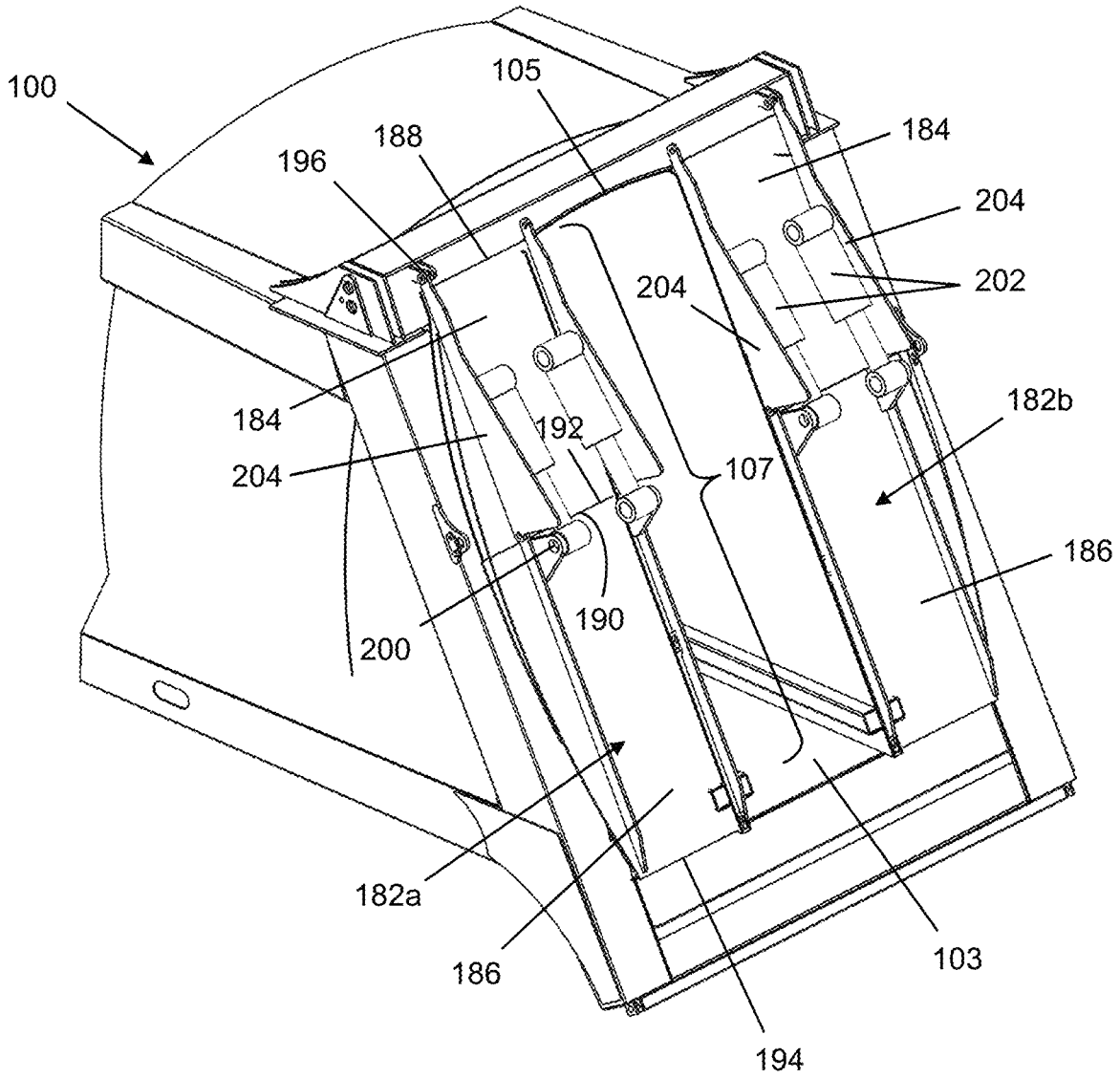
FIG. 5 is an oblique view of the rear of a three compartment body with both side compartments closed by respective composite shields according to a disclosed embodiment.
Figure 6:
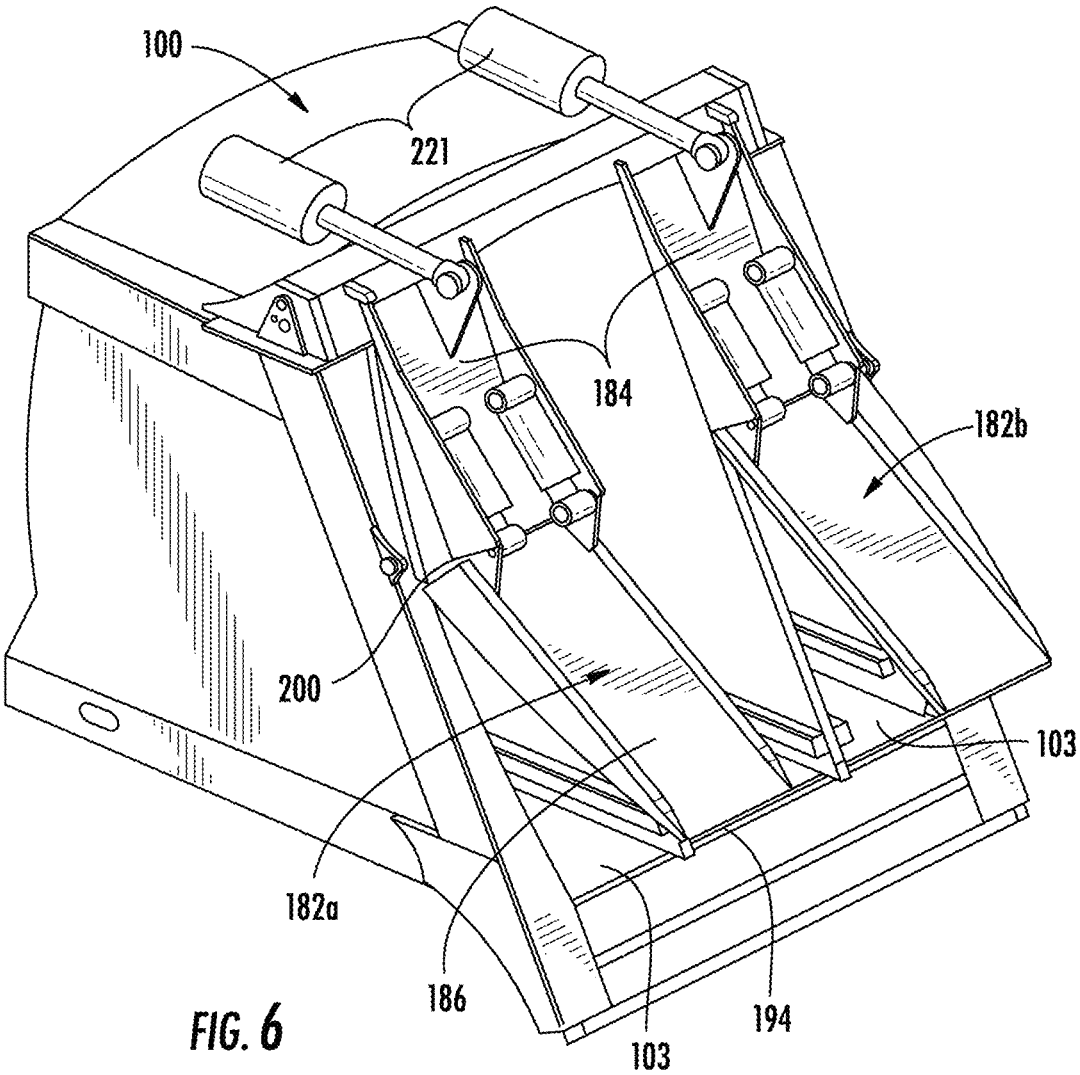
FIG. 6 is a view similar to FIG. 5, showing each shield in a normal packing mode of operation.

FIGS. 5-8 illustrate a composite shield 182*a*, 182*b* provided for each side (outboard) compartment 114, 118, with an upper segment 184 and a pivotally connected lower segment 186. As shown in FIG. 5, the shield upper segment 184 has top and bottom ends 188, 190, and the lower segment 186 has top and bottom ends 192, 194. A first hinge mechanism 196 at the top end of the upper segment 184 provides a pivotal connection to the truck body 100, and a second hinge mechanism 200 operatively connects the lower segment 186 to the upper segment 184. According to aspects of the disclosure, hydraulic actuators 202, 204 are connected between the upper segment 184 and lower segment 186 of the composite shields 182*a*, 182*b* to selectively pivot the second hinge 200 and thereby angulate the lower segment 186 relative to the upper segment 184 as shown in FIG. 6.

In a refuse truck body 100 and packing unit 101 as shown in FIGS. 5-8, composite shields 182*a*, 182*b* are provided for the outboard compartments 114, 118, but not for the center compartment 116. The composite shields 182*a*, 182*b* are arranged between the compartment 114, 118 and the packing unit 101, and contain refuse being compacted into the compartments 114, 118 without the need for a plate or containment structure on the inside face of the packing unit 101. The center compartment 116 is not provided with a composite shield, so the inside face of the packing unit 101 must include a plate or containment structure (not shown) to contain refuse being compacted into the center compartment 116.

Figure 7:
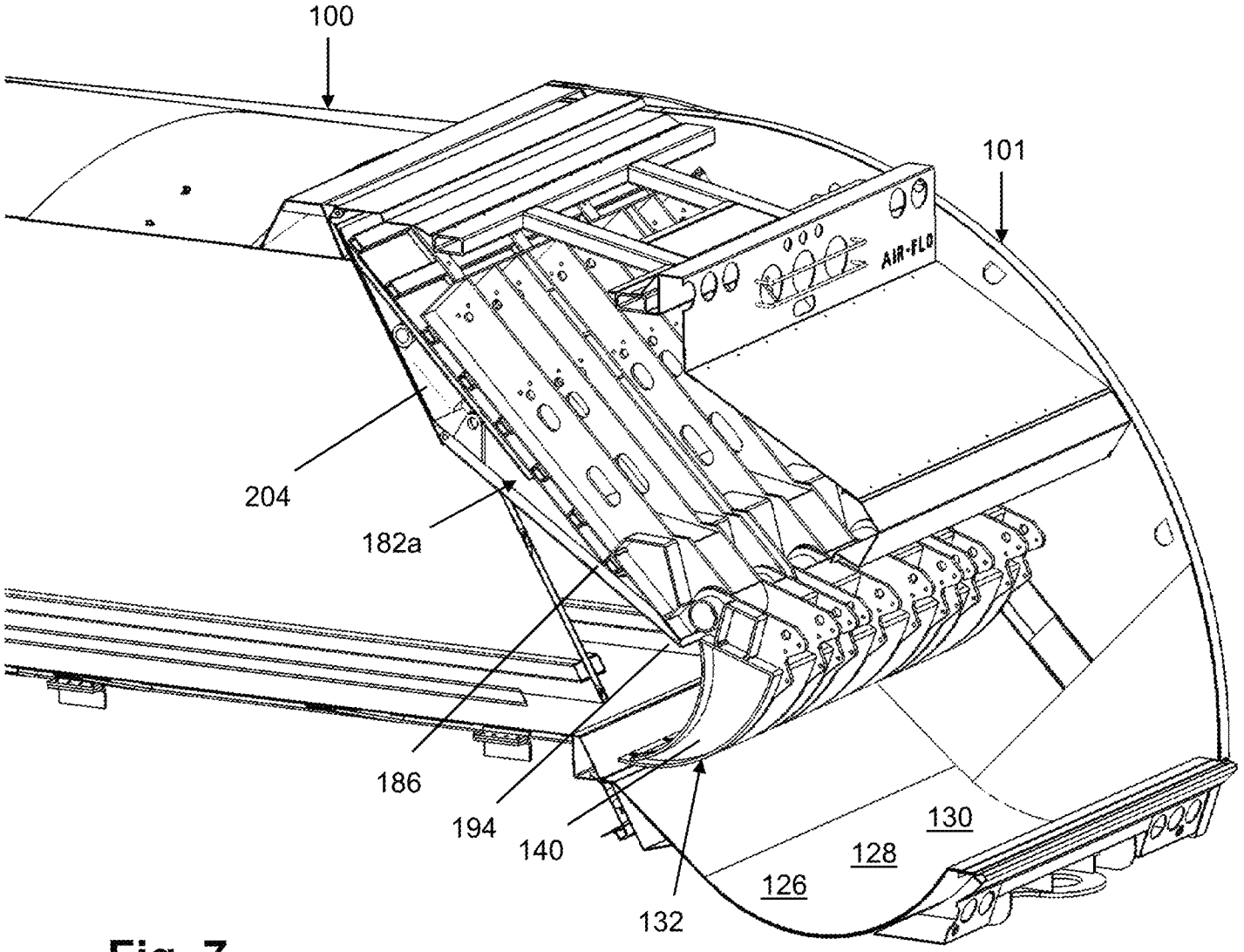
FIG. 7 shows the packing unit with pack blade and sweep blade, in relation to the shields in the normal packing position shown in FIG. 6.

The composite shield configuration shown in FIGS. 5-8 allows at least two modes of operation. When a vehicle equipped with the truck body and composite shields 182*a*, 182*b* is being used to collect refuse, the lower segment 186 is moved to the angulated "loading" position shown in FIGS. 6 and 7. In the angulated loading position, the lower segment 186 of each shield 182*a*, 182*b* guides refuse into the respective side compartment as shown in FIG. 7. In the angulated loading position, the bottom end 194 of the lower segment 186 is held above the compartment floor 103 so that retraction of the pack blade (step 4 in FIG. 2) moves the sweep blade 132 toward the respective compartment 114, 118, with the working area of the sweep blade sections 140, 142, 144 passing under bottom end 194 of the lower segment 186.

According to aspects of the disclosure, a sequence of steps are required to begin offloading of refuse without spilling or mixing of the refuse. First, the vehicle is moved to a location for offloading refuse in the center compartment 116. Second, a set of hydraulic actuators 202, 204, cylinders, rotary actuators, or the like close the lower segment 186 of each composite shield 182*a*, 182*b*, as shown in FIG. 5. Optionally, a mechanical device (not shown) connected to the packing unit 101 can close the lower segments 186. The composite shields 182*a*, 182*b* may be configured to latch in the closed position, as described in greater detail below. When the lower segment 186 of each shield is closed, the packing unit 101 can be raised to its open position as shown in FIG. 8. With the upper segment 184 and lower segment 186 of the composite shields 182*a*, 182*b* in the closed position illustrated in FIG. 5, raising the packing unit 101 exposes the compartment opening 107 of the center compartment 116, and refuse in outboard compartments 114, 118 is contained. Extension of the center ejection hydraulic cylinder 170 pushes compacted refuse in the center compartment 116 out the opening 107.

When the vehicle has been re-located to empty one side compartment, the entire shield 182*a* of that compartment is unlatched from the body 100 and freely pivotable upward at hinge 196 to allow that compartment to unload, as shown in FIG. 8. This upward pivot can then be repeated for the shield 182*b* on the opposite side compartment in whichever order is the preferred sequence for unloading. If the refuse being pushed out of a given compartment does not apply sufficient force to passively swing and maintain the respective shield fully open to permit full removal of the refuse from the compartment, a brace (not shown) between the shield 182*a*, 182*b* and the body 100 or a hook 115 (see FIG. 20) between the shield and the packing unit 101, 242 (not shown in FIG. 20) can be secured for the dumping mode.

Figure 17:
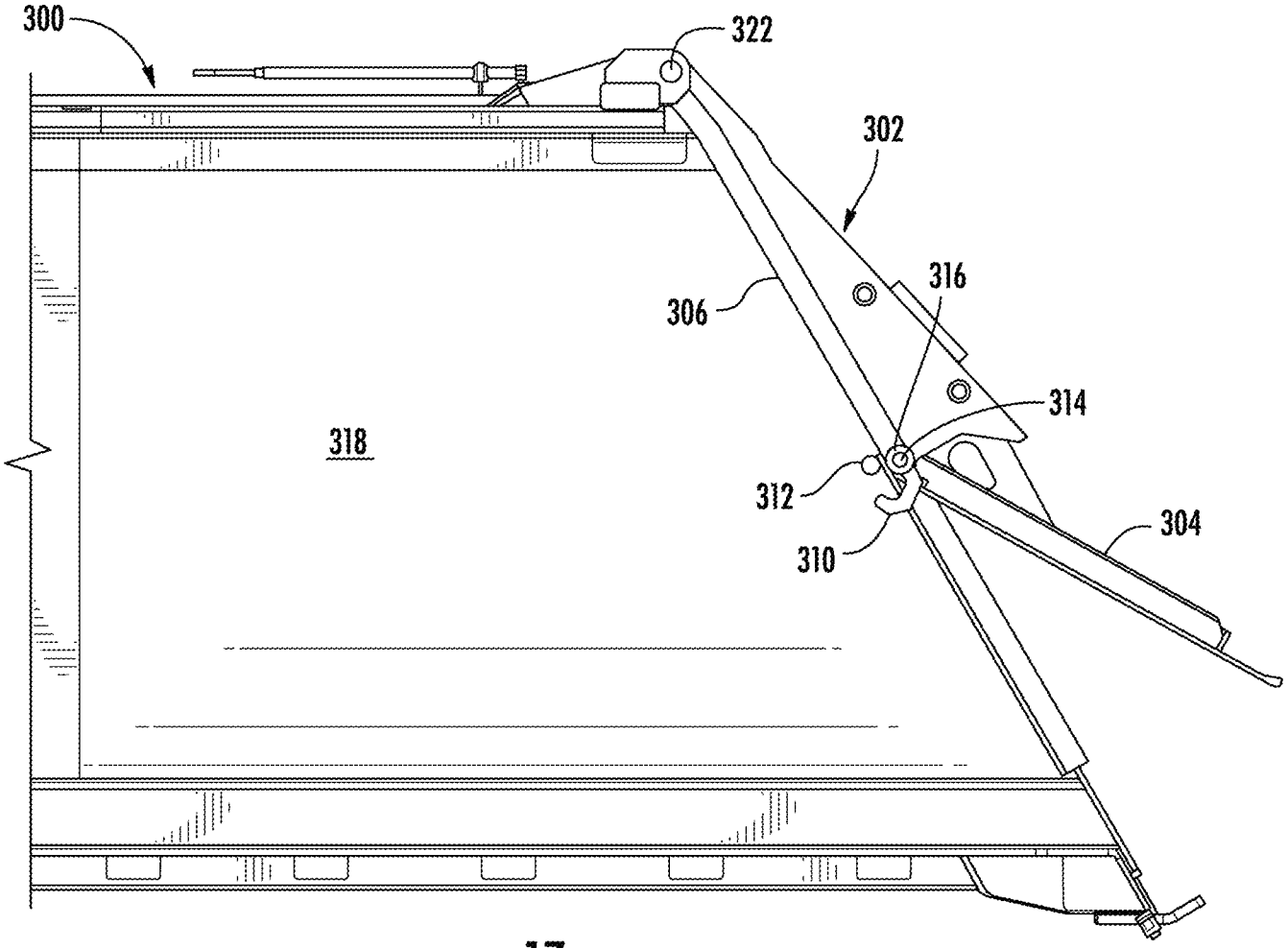
FIG. 17 is a side sectional view of the garbage truck and shields of FIG. 16, with the lower shield in an open, unlatched position.
Figure 18:
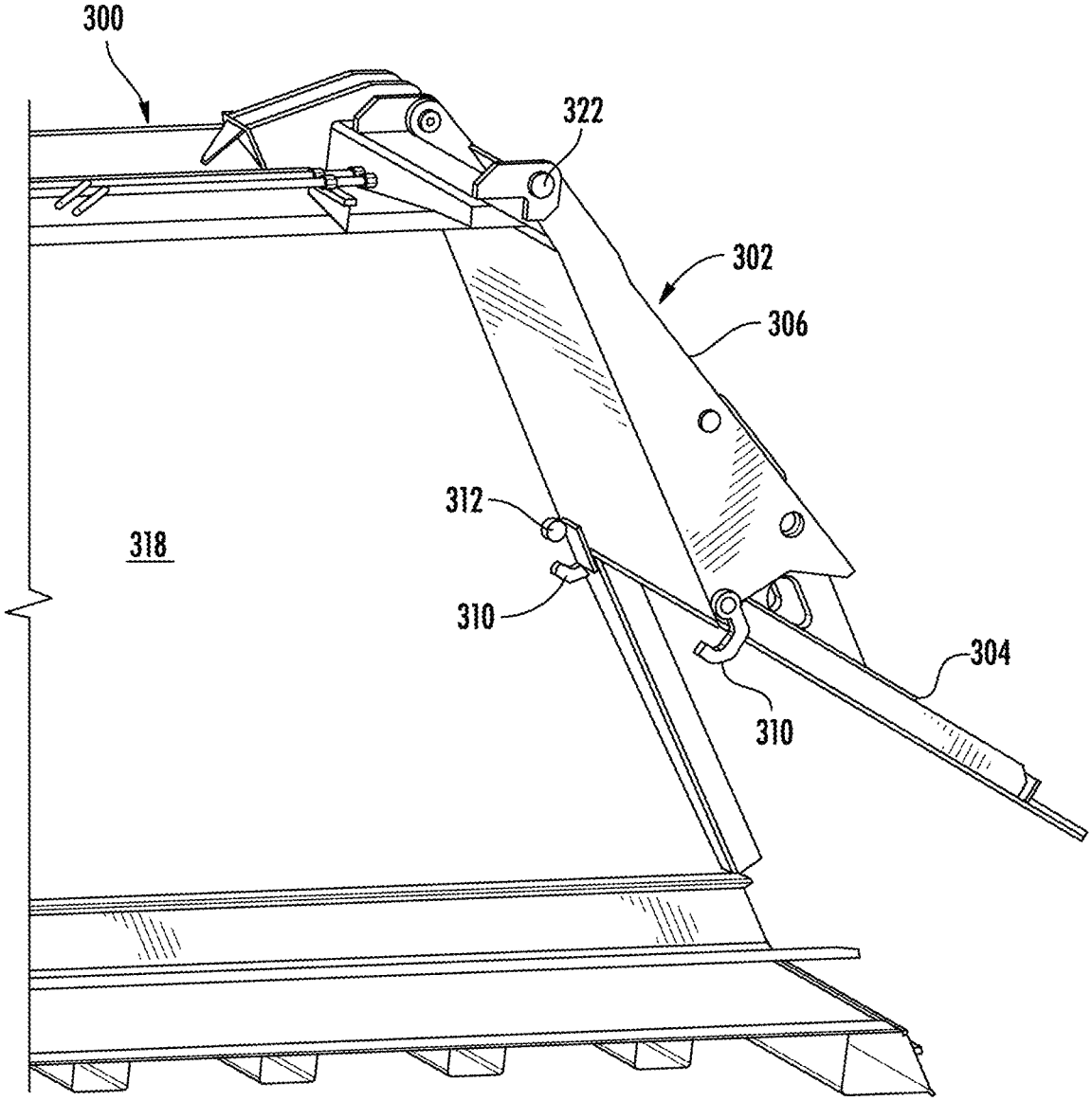
FIG. 18 is a perspective view of the sectional view of FIG. 17.
Figure 19:
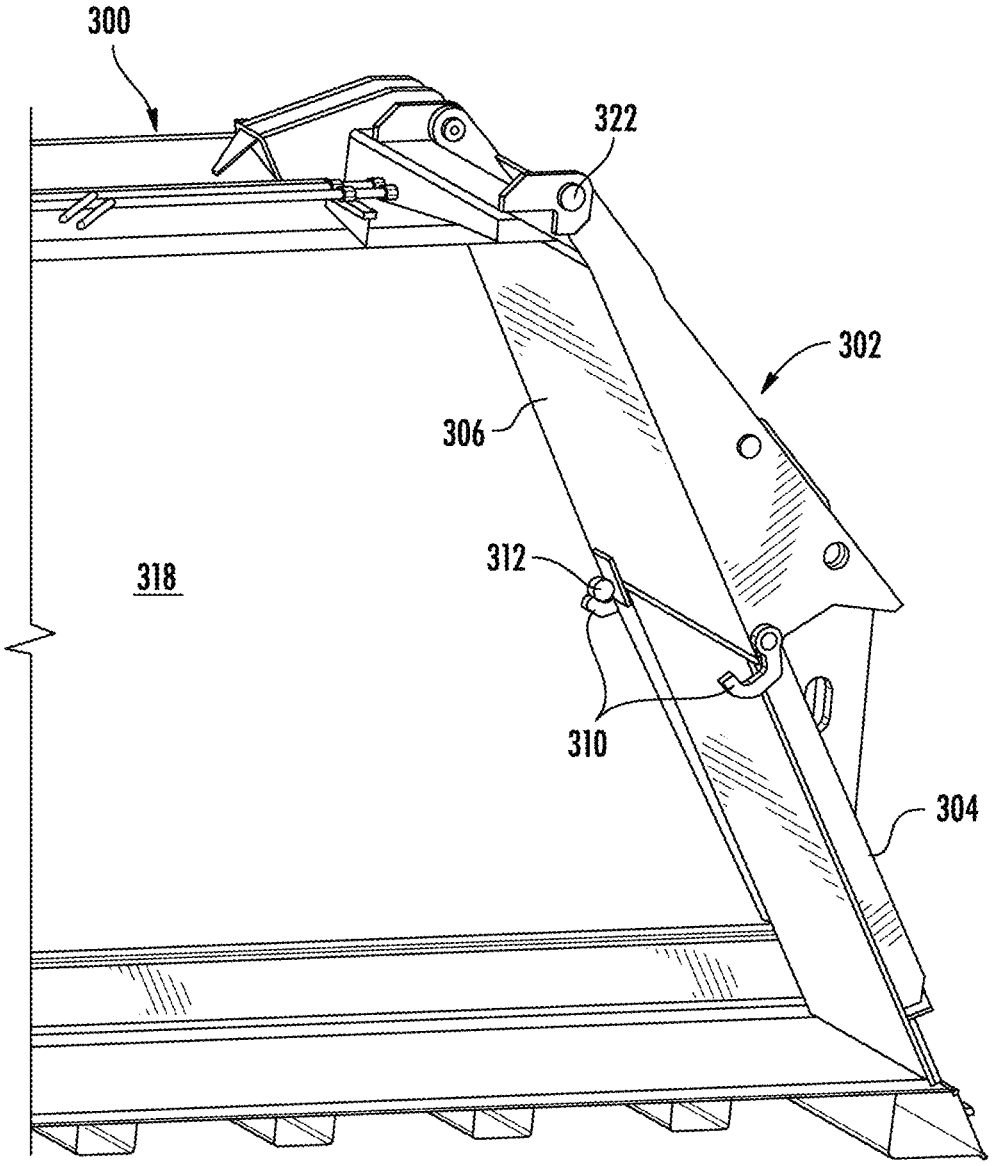
FIG. 19 is a perspective view of the sectional view of FIG. 17, with the lower shield in a closed, latched position.
Figure 20:
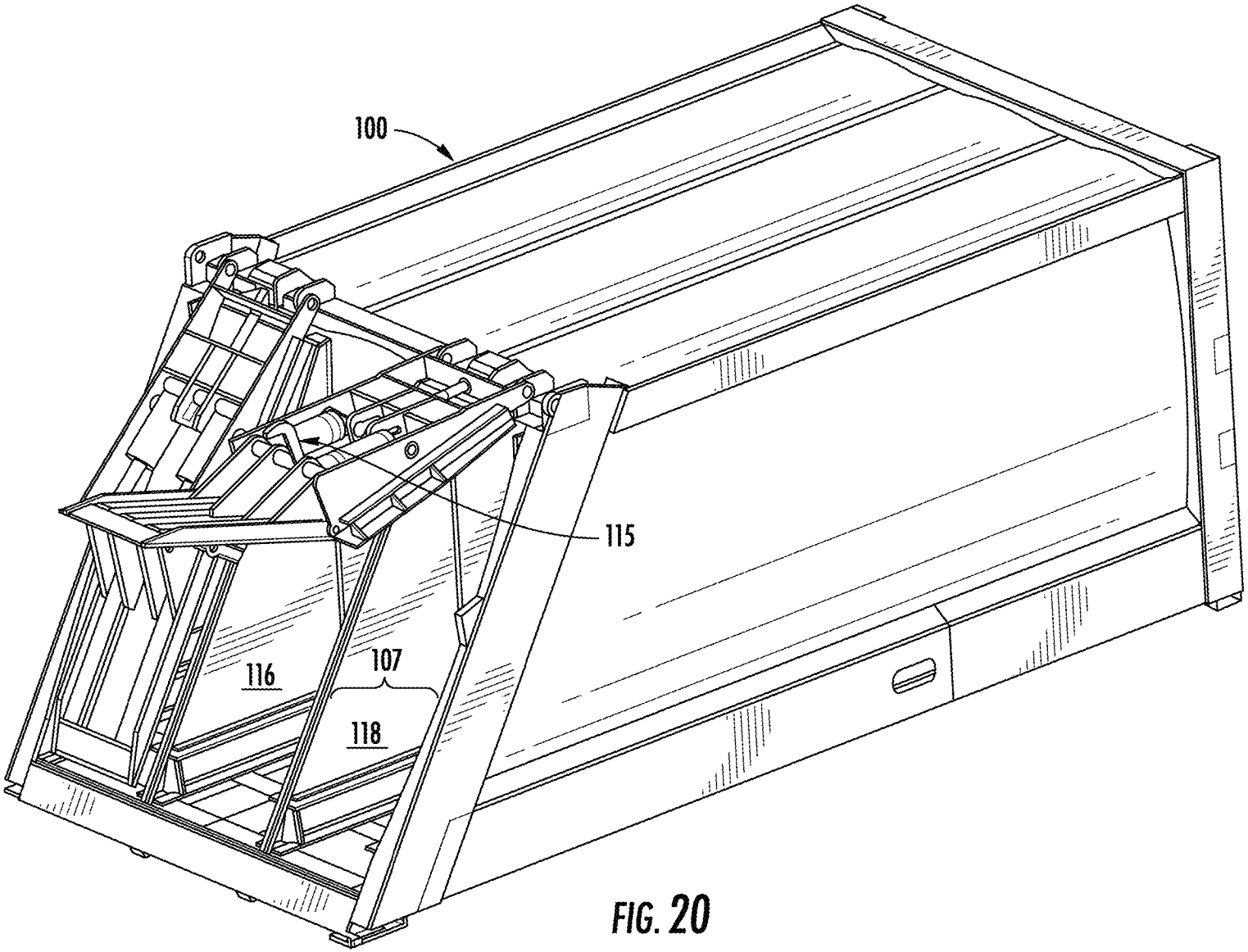
FIG. 20 is a rear perspective view of a refuse truck body showing a hook for raising a composite shield along with a packing unit according to aspects of the disclosure.

In an embodiment according to FIG. 20, a respective shield 182*a*, 182*b*, 206, 302 is capable of mechanically coupling to the packing unit 101, 242 so that raising the packing unit 101, 242 also raises the respective mechanically coupled shield 182*a*, 182*b*, 206, 302. A rotary lock or latch 310/312 as shown in FIGS. 17-19 is coupled to the hook 115 so that when the hook 115 is rotated into a position to connect the shield 182*a*, 182*b*, 206, 302 to the packing unit 101, 242, the rotary lock 310/312 is rotated to the unlatched position illustrated in FIGS. 17 and 18. With the hook 115 connected between the shield 182*a*, 182*b*, 206, 302 and the packing unit 101, 242, raising the packing unit 101, 242, also raises the shield 182*a*, 182*b*, 206, 302 in a dumping mode where refuse can be ejected through an unobstructed compartment opening 107. In the embodiment shown in FIG. 20, the center compartment 116 is emptied first, the packing unit is lowered, the vehicle is moved to another discharge station, the shield 182*a*, 182*b*, 206, 302 is unlatched and the hook 115 connected between the shield 182*a*, 182*b*, 206, 302 and the packing unit 101, 242, and the packing unit 101, 242 is raised, opening the shield along with the packing unit to the position shown in FIG. 20 to permit discharge of refuse from right side compartment 118. The steps of lowering the packing unit, unlatching the other shield, connecting the hook for the left side compartment with the packing unit, and raising the shield along with the packing unit are repeated to permit discharge of refuse from the left side compartment. Although a hook 115 is shown, one skilled in the art will recognize that other forms of releasable mechanical coupling between the shield and the packing unit are possible. The shield latch mechanism may be mechanically coupled to the hook 115 so that the hook cannot be engaged without release of the latch. Alternatively, the latch and hook may be mechanically separate structures, but controlled by actuators to provide the required functionality, e.g., the latch must be released when the hook is connected to the packing unit.

In an alternative embodiment shown in FIG. 6, the upper shield segment 184 may be connected to the truck body 100 by one or more hydraulic actuators 221 to move the composite shield 182*a*, 182*b* to the open position shown in FIG. 8 and hold it open during the offloading process. Since the lower shield segment 186 is connected to the upper shield segment 184, and the position of the lower shield segment 186 is determined by the hydraulic actuator 202, 204, the actuators 221 arranged to raise the upper shield segment 184 will raise both shield segments as shown by the position of composite shield 182*a* in FIG. 8.

After offloading of refuse is complete, the composite shields 182*a*, 182*b* return to the closed position of FIG. 5 by their own weight, or are closed by an actuator connected between the upper shield segment 184 and the truck body 100 (not shown). The packing unit 101 is then lowered to the closed position shown in FIG. 7. The lower shield segment 186 can then be raised to the "loading" position of FIG. 6 to prepare for loading again, as shown in FIG. 7. The packing unit 101 will secure the composite shields 182*a*, 182*b* between itself and the truck body 100. Raised side walls 204 on the upper segments 184 provide stop limits against the packing unit 101 when in the closed position shown in FIG. 7 and in the raised position shown in FIG. 8. In FIG. 7, the refuse separators 122, 124 between the three sumps 126, 128, and 130 are omitted for clarity.

Figure 9:
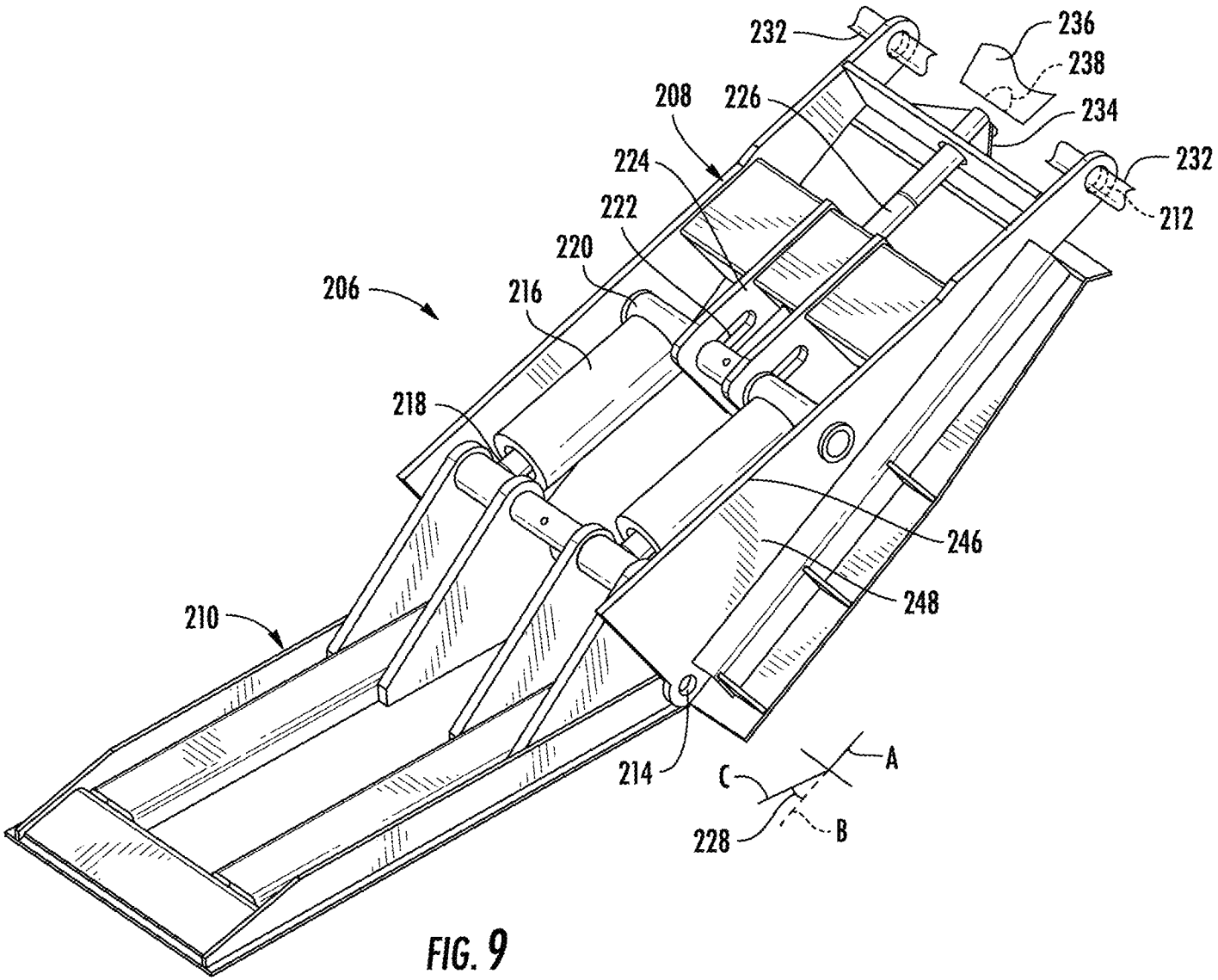
FIG. 9 shows one implementation for the disclosed shields.
Figure 10:
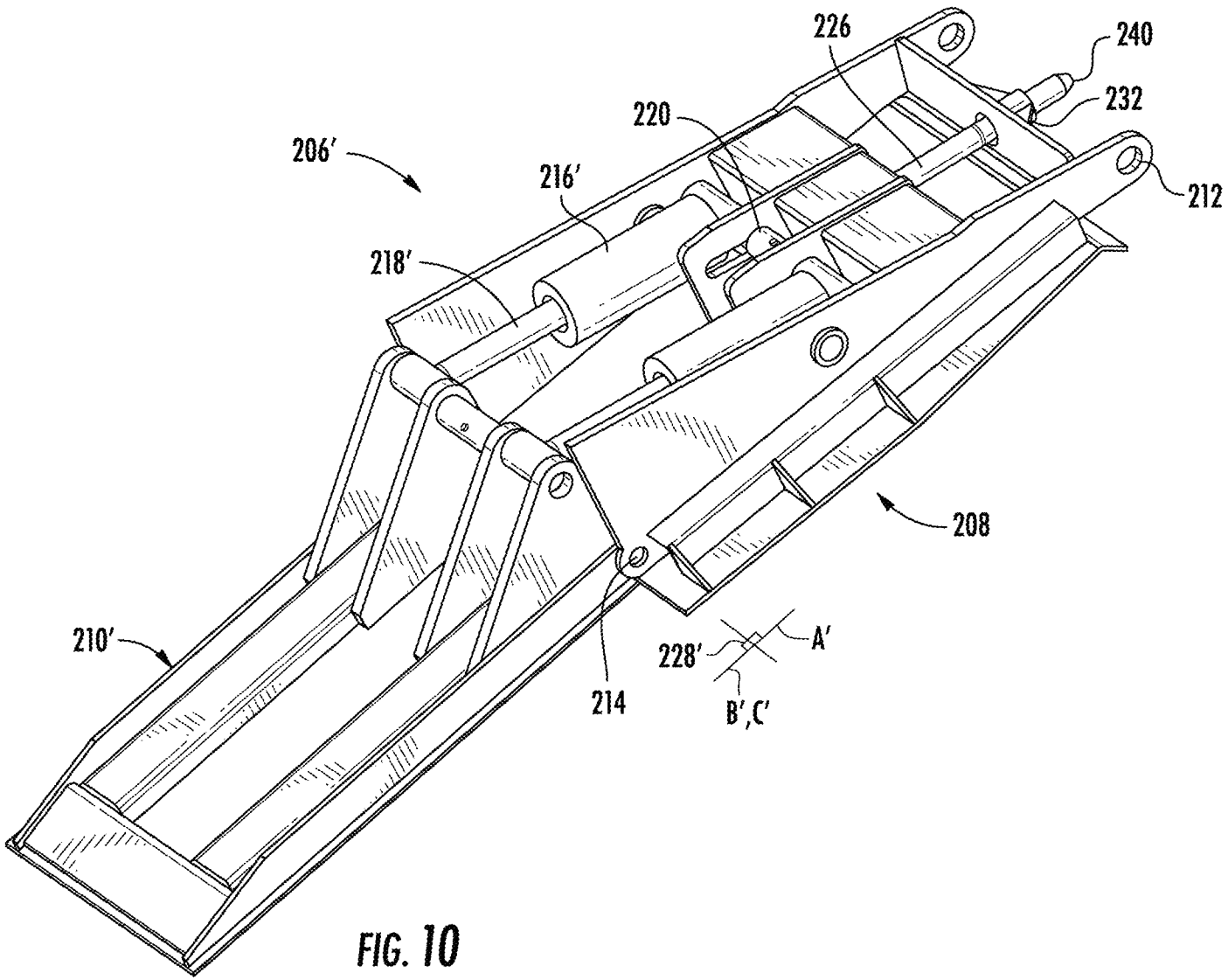
FIG. 10 shows one position of the actuating cylinders for angulating the shield segments.

FIGS. 9-12 and 14 illustrate an alternative composite (segmented) shield 206 incorporating a latch mechanism to retain the composite shield 206 in the closed position when the packing unit is raised to offload refuse. Each composite shield 206 has an upper segment 208 and a lower segment 210, with a first hinge 212 at the top end of the upper segment 208 and a second hinge 214 between the upper segment 208 and the lower segment 210. Two actuation cylinders 216 with associated shafts 218 are mounted in the upper segment 208 with a cross member 220 connecting the cylinders 216 and displaceable longitudinally (along the length of the upper segment 208) in slot 222 in bracket 224. The cross member 220 is mechanically connected to one end of a longitudinal rod 226, with the other end of the rod forming a latching pin 240. Displacement of the cross member 220 and connected rod 226 in slot 220 cause the latching pin 240 to project from a latching boss 234 as shown in FIG. 10, or be retracted within the latching boss 234 as shown in FIG. 9. With the lower segment 210 in the angulated position shown in FIG. 9, the upper segment 208 lies on a plane indicated at A, with its extension indicated by dotted line B, whereas the lower segment 210 lies in the plane indicated by C, forming an angle 228 that has a vertical component relative to plane A. In this configuration, the latching pin 240 of the rod 226 is retracted within the latching boss 234, and the composite shield 206 is free to pivot around axles 232 at hinge 212 on the roof of the compartment. Allowing the entire composite shield 206 to pivot at hinge 212 effectively opens the entire rear opening 107 of the respective refuse compartment during offloading of refuse.

When the cylinders 216 are powered to move the lower segment 210 such that the lower segment 210 is on a plane indicated at B, linearly aligned with the plane A of the upper segment (the closed position), the segments 208, 210 are substantially co-planar as indicated at 228. As the cylinders 216 and associated shafts 218 are powered to the position shown in FIG. 10, the cross member 220 advances through slot 222, also advancing rod 226 and latching pin 240. In the closed, latched position shown in FIG. 10, the latching pin 240 is received within the mating profile 238 of receptacle 236 shown in FIG. 9. This prevents the upper segment from pivoting at hinge 212. It will be understood by those skilled in the art that the composite shield is constructed and arranged to close the opening of a refuse compartment when the packing unit is in the elevated, open position for offloading refuse. In the embodiment of a truck body illustrated in FIGS. 5-8, the rear edges of the compartment openings are linear, extending in a straight line from the roof 105 to the floor 103 of the rear-facing openings 107 of the refuse compartments 114, 116, 118. For this configuration of truck body and refuse compartment openings, the closed position of the lower shield segment 210 is co-planar with the closed position of the upper shield segment 208. For a compartment opening where the rear edges are not linear, the closed position of the lower shield segment will not be co-planar with the closed position of the upper shield segment.

It can thus be appreciated that a latch 236/240 is situated at the top end of the upper segment 208 for selective activation and deactivation. The lower segment actuators 216 are operatively connected to the rod 226 and latching pin 240 whereby the latch 236/240 is activated or deactivated by the actuator 216 simultaneously with the pivoting of the lower segment 210 to the open position shown in FIG. 6. The actuator 216 pivots the lower segment 210 between the closed position shown in FIGS. 5 and 10 and the open position shown in FIGS. 6 and 9, whereby in the open position the lower segment 210 is angled upward relative to the upper segment 208. In the closed position of the lower segment 210, the latch 236/240 is activated, and in the open position of the lower segment 210 the latch is deactivated (latch pin 240 is retracted from receptacle 236). In the presently illustrated embodiment, the latch mechanism is a latch pin 240 and an associated mating receptacle 236, but other forms of latch can be implemented for activation and deactivation produced by the same movement of the actuators that angulate a lower segment of a composite shield relative to the upper segment. In whatever form, the activated latch prevents the upper segment 208 of the shield from pivoting around the hinge 212, and in the form shown, maintains the closed composite shield 208/210 in fixed relation to the truck body 100.

Figure 11:
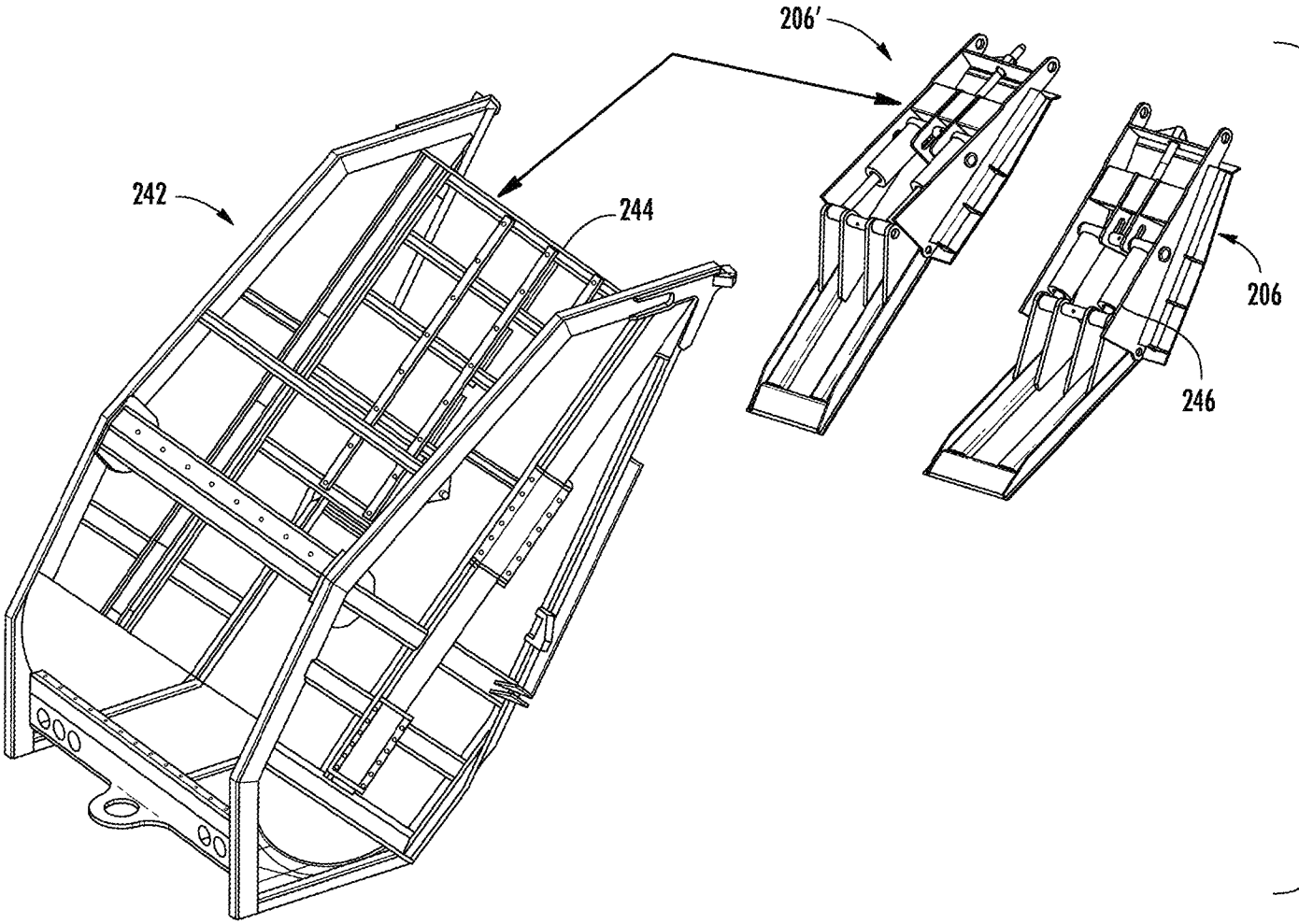
FIG. 11 shows another position of the actuating cylinders for angulating the shield segments.

FIG. 11 illustrates the open condition 206 and the closed condition 206' of the shield in relation to one example of a packing unit 242. The underside of the packing unit 242 includes a matrix or a similar substantially flat layer 244 which spans the width of the packing unit 242 and in one and optionally two modes of operation bears against the edges 246 of the tapered, vertical side plates 248 of the upper segment 208 each of the shields 206. One mode is for packing, with the packing unit 242 closed and the lower segment 210 open. The closed packing unit will hold the upper shield segment 208 in the closed position even though the lower shield segment 210 is in the angulated (open) position and the latch 236/240 is not engaged. According to aspects of the disclosure, the lower shield segment 210 is moved to the closed position and the latch 236/240 is engaged, whereby the entire shield 206 is closed for both side compartments during transport of a full truck to the dumping facility. The lower shield segment 210 is also moved to the closed position and the latch 236/240 engaged before raising the packing unit 242 to offload refuse.

Shields 206 of FIGS. 9-12 and 14 have counterparts 182*a*, 182*b* in FIGS. 5-8. FIG. 8 illustrates the packing unit 101 raised in preparation for offloading refuse, the center compartment 116 having been fully discharged, the composite shield 182*a* for the left side compartment 114 fully open for discharge, while the composite shield 182*b* for the right side compartment 118 is fully closed. Shield 182*a* is freely hinged at the top, whereas shield 182*b* is forced closed against its compartment. FIG. 9 shows the open, unlatched condition 206 of shield 182*a* of FIG. 8 and FIG. 10 shows the preferred closed, latched condition 206' of shield 182*b* in FIG. 8.

Thus, the open, unlatched condition of the shield 206 depicted in FIG. 9 is present in two modes of operation: the packing mode depicted in FIG. 6, where the upper segment 208 is fixed against the body by the packing unit 101 (FIG. 8), 242 (FIG. 11) and the lower segment 210 is at a fixed angle above the compartment floor 103, and in the dumping mode where the upper segment 208 freely pivots and the lower segment remains fixed at an angle 228 to the upper segment as the discharging refuse pushes the shield 182*a*, 182*b*, 206. Similarly, the latched condition of FIG. 10 is present in two closely related modes: the fully closed mode of operation depicted in FIG. 5 and the partially closed mode of operation depicted at 182*b* in FIG. 8.

As noted above, in the packing mode of operation the matrix 244 of the packing unit 242 preferably bears against the edges 246 of the upper segment to keep the upper segment 208 closed against the upper region of the compartment 114, 118. The elevation of the side walls or panels 248 at the hinge 214 between the upper segment 208 and lower segment 210 is such that the bottom edge of the lower segment 210 when in the open position, avoids interference with the lower portion of the packing unit 242. In an alternative embodiment a separate power source such as one or more hydraulic cylinders 221 (FIG. 6), would keep the upper segment 208 closed against the upper region of the compartment 114, 118 when extended, and when retracted have the capability of moving the shield 206 to a fully open position when the packing unit 101, 242 is raised, so that refuse can be ejected through the entire opening 107 at the rear of the refuse compartment 114, 118 without the need for refuse to force the shield 206 to the open position. Powered actuation of the shield 206 to the open position may facilitate more complete offloading of refuse by permitting refuse to fall freely out of the rear opening 107 of the compartment 114, 118 free of the resistance posed by the weight of the shield 206. In a coordinated sequence of operations, powered actuation of the shield 206 to the open position would take place only after the packing unit 101, 242 is raised.

With reference to FIGS. 5-15, an automated, coordinated, and sequential unloading or discharge operation will be described in further detail. FIGS. 6 and 7 illustrate the position of the lower shield segments 186 and the packing unit 101 during collection and packing of refuse. When one or more of the refuse compartments 114, 116, 118 are filled with compacted refuse, the vehicle is taken to a site for the offloading of refuse into collection stations for each type of refuse. To prevent inadvertent spilling (and mixing) of refuse when the packing unit 101 is raised, each shield 182*a*, 182*b* must be in a straight configuration, fully covering the respective side compartments 114, 118, preferably with the upper shield segment 184 latched to the roof by pin 240. This exposes the center compartment 116 for the discharge of refuse, while the side compartments 114, 118 are securely closed. Before beginning the discharge operation by raising the packing unit 101, the operator must remember to straighten (close) both shields 182*a*, 182*b*, from the angled configuration deployed during packing (with retracted pin 240 per FIGS. 6, 7 and 9), to the straight, latched configuration shown in FIGS. 5 and 10. As shown in FIG. 8, after the center compartment has been emptied, the operator must remember to move the lower shield segment 186, 210 to the open position, which retracts the latch pin 240 for one shield 182*a*, while the shield for the other side compartment 182*b* remains closed and preferably latched in the closed position as shown in FIG. 8. Pressure against the unlocked shield 182*a* due to the ram 168 pushing on the refuse in the left compartment 114 pivots the unlatched shield 182*a* at hinge 196 to permit discharge of the refuse. Alternatively, shields 182*a*, 182*b* can be provided with one or more hydraulic actuators such as 221 shown in FIG. 6 to move the shield to an open position shown in FIG. 8.

According to aspects of the disclosure, the truck body and packing unit may be provided with sensors to detect the position of the composite shields 182*a*, 182*b*, 206 and controls that do not permit (1) opening the packing unit 101, 242 before the shields 182*a*, 182*b*, 206 are closed and latched or (2) actuating an ejector cylinder 168, 172 to eject refuse before unlatching the shield for the corresponding compartment. In a truck body equipped with actuators 221 for raising the shields to an open position, the controls will not permit retraction of the actuators 221 to raise the shields until the packing unit 101, 242 has been raised.

Figure 13:
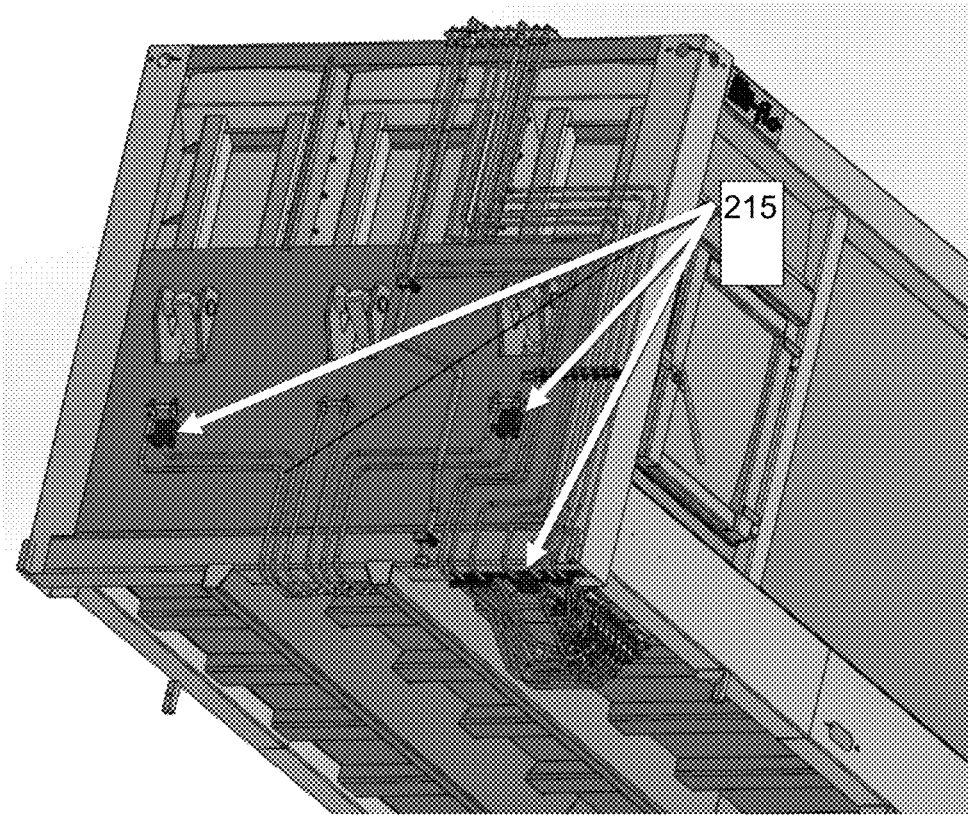
FIG. 13 shows one, externally mounted embodiment of a suitable configuration of hydraulic sequencing valves.
Figure 14:
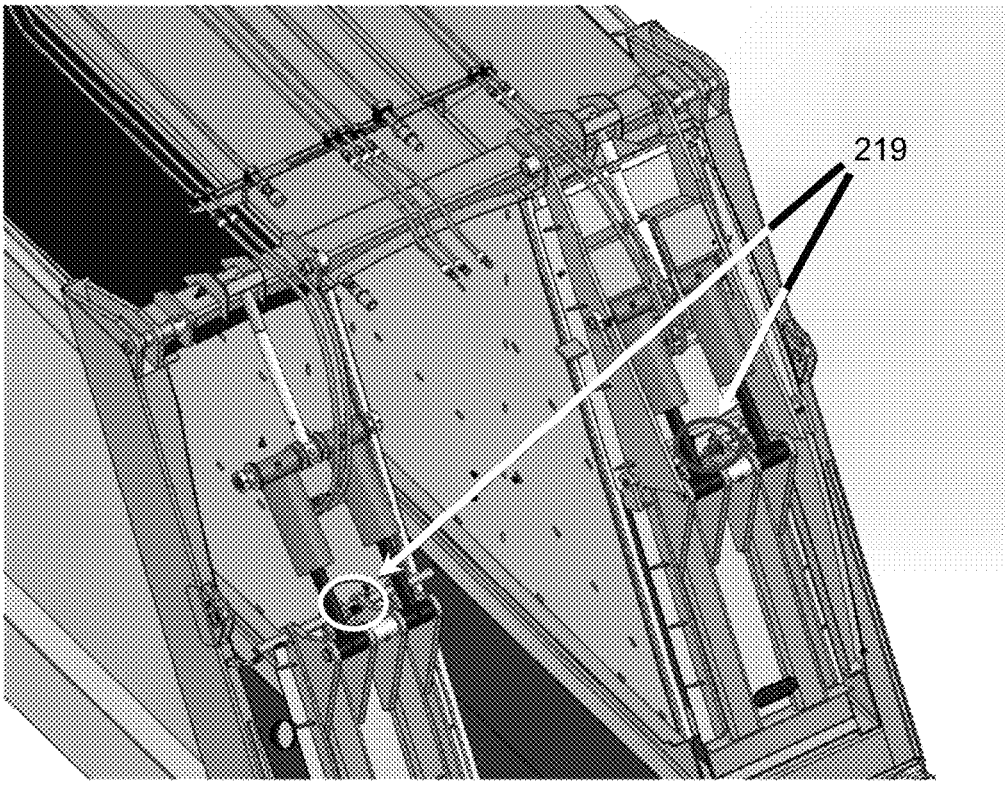
FIG. 14 shows the locations of sensors to detect the positions of the shields.

The sequencing method is set forth below with reference to FIGS. 12-14. Using a series of hydraulic sequence valves 215*a-e* schematically illustrated in FIG. 15, upon activation of the packing unit unlock function by the operator, flow will be diverted to the lower shield segment actuators 202 (FIGS. 5, 6), 216 (FIGS. 9, 10) to extend and lock the lower shield segments 186 (FIGS. 5-8), 210 (FIGS. 9, 10) in the closed position before allowing the ejector 168, 172 to extend to empty the compartment 114, 118. A manual control handle may be provided to allow an operator to open the shields manually at any time. This allows the operator to place the shields in the open position shown in FIG. 6 before loading refuse into the compartments 114, 118. A warning indicator and/or an interlock can be provided to prevent operation of the packing mechanism without the shields in the open position.

Figure 12:
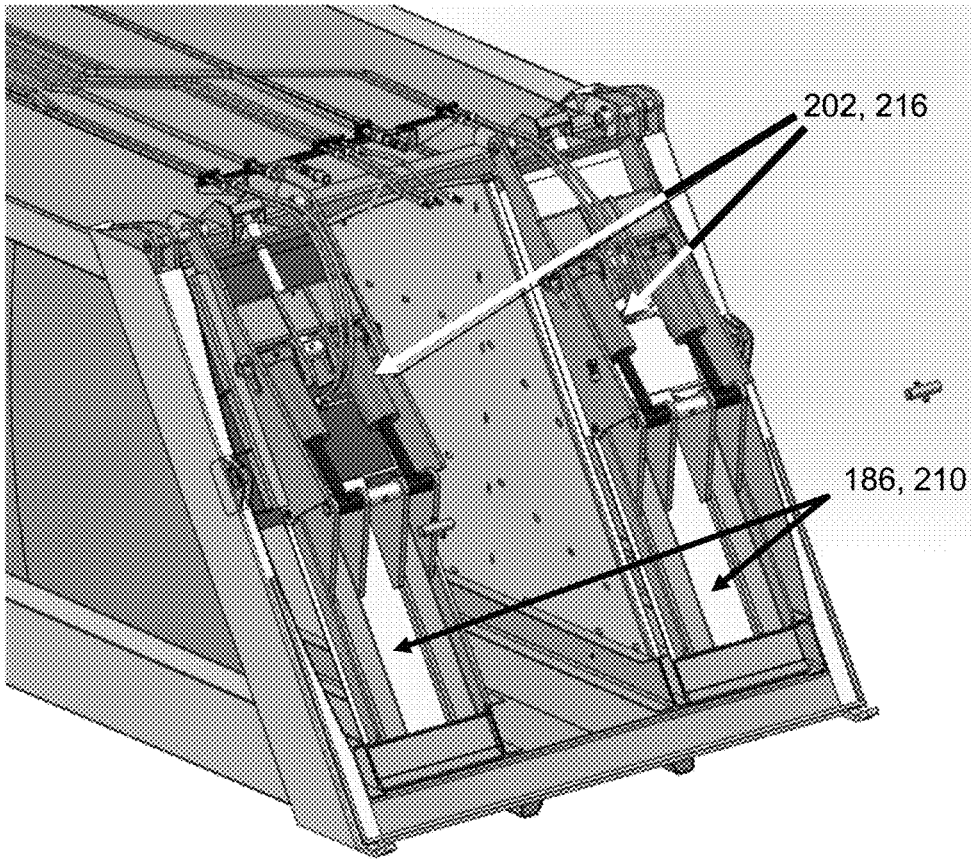
FIG. 12 shows the hydraulic lines, with the shield closed.
Figure 15:
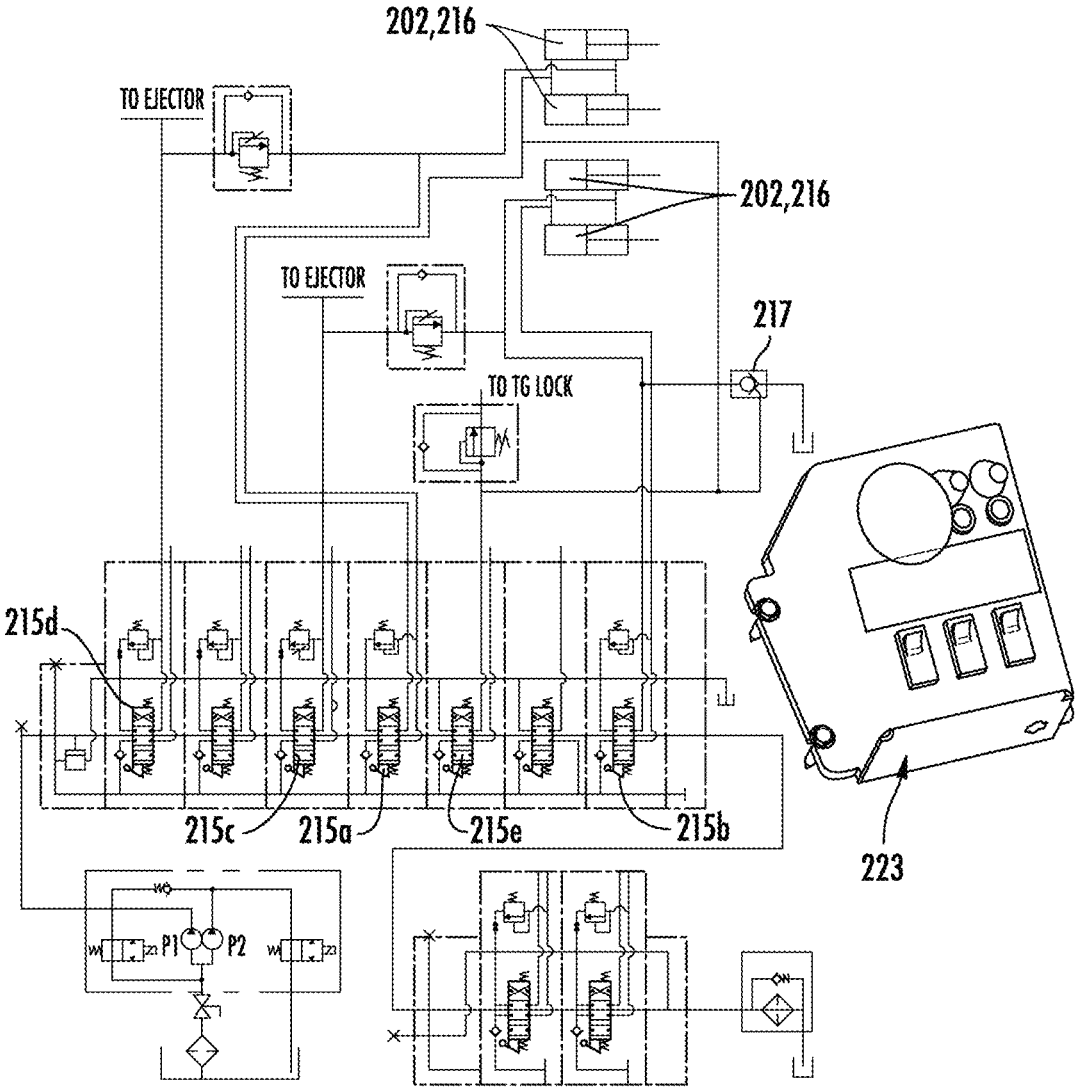
FIG. 15 is a hydraulic schematic for implementing suitable valve configuration and sequencing.

FIG. 12 illustrates hydraulic fluid connections to the actuators 202, 216 for the lower door segments 186, 210. When the actuators 202, 216 for the lower shield segments 186, 210 reach full pressure as sensed by a sequence valve 215*e*, flow will be returned to the packing unit unlock function, allowing the packing unit to unlock and then be raised. Diversion of flow can be accomplished by the use of a combination of sequence valves either externally mounted as shown in FIG. 13, or internal to the control valve stack. It will be understood by those skilled in the art that similar functionality can be produced using electronic controls and that the disclosed functionality is not limited to a control system employing hydraulic sequence valves. An example of a control box 223 associated with such an electronic control system is shown in FIG. 15. The control box 223 may include a microcontroller with memory loaded with firmware configured to receive inputs from sensors and actuate hydraulic valves according to a programmed sequence duplicating the coordinated sequence of actions produced by the above-described hydraulic sequence valves. The use of electronic controls, including the connection and programming of a control box 223 are well-understood and can be implemented by those skilled in the art.

After the packing unit 101, 242 is raised, the operator will in normal operation activate the valve for the respective pushing device (168, 172 in FIG. 2.) to eject refuse from one of the side compartments 114, 118. A similar sequence valve 215*c*, 215*d* can be used to divert hydraulic pressure to first unlock the shield 182*a*, 182*b*, 206 for a side compartment 114, 118 before hydraulic pressure is delivered to extend the pushing device (168, 172) for the respective compartment 114, 118. When the sequence valve 215*c*, 215*d* detects hydraulic pressure corresponding to the lower door segment 186, 210 reaching a position where the shield is unlatched, the sequence valve will 215*c*, 215*d* again return flow to the ejector cylinder 168, 172 of the corresponding compartment 114, 118, allowing the ejector 168, 172 to empty the compartment. A pilot operated check valve 217 on the return line of the actuators 202, 216 for the lower door segments 186, 210 will allow oil to return to the tank, bypassing the main control valve (?) as is known in the art. Prior to returning the vehicle to refuse collection, the packing unit 101, 242 is lowered and the lower shield segments 186, 210 are moved to the open position shown in FIGS. 6 and 7. As shown in FIG. 14, a sensor 219 may be located on each of the composite shields 182*a*, 182*b*, 206, to detect the position of the lower shield segments 186, 210. This sensor can be of any suitable type and can be placed in any location that it will reliably detect whether the lower shield segments 186, 210 are open or closed. This sensor may also be connected to an indicator light near the operation controls for raising and lowering the packing unit.

Figure 16:
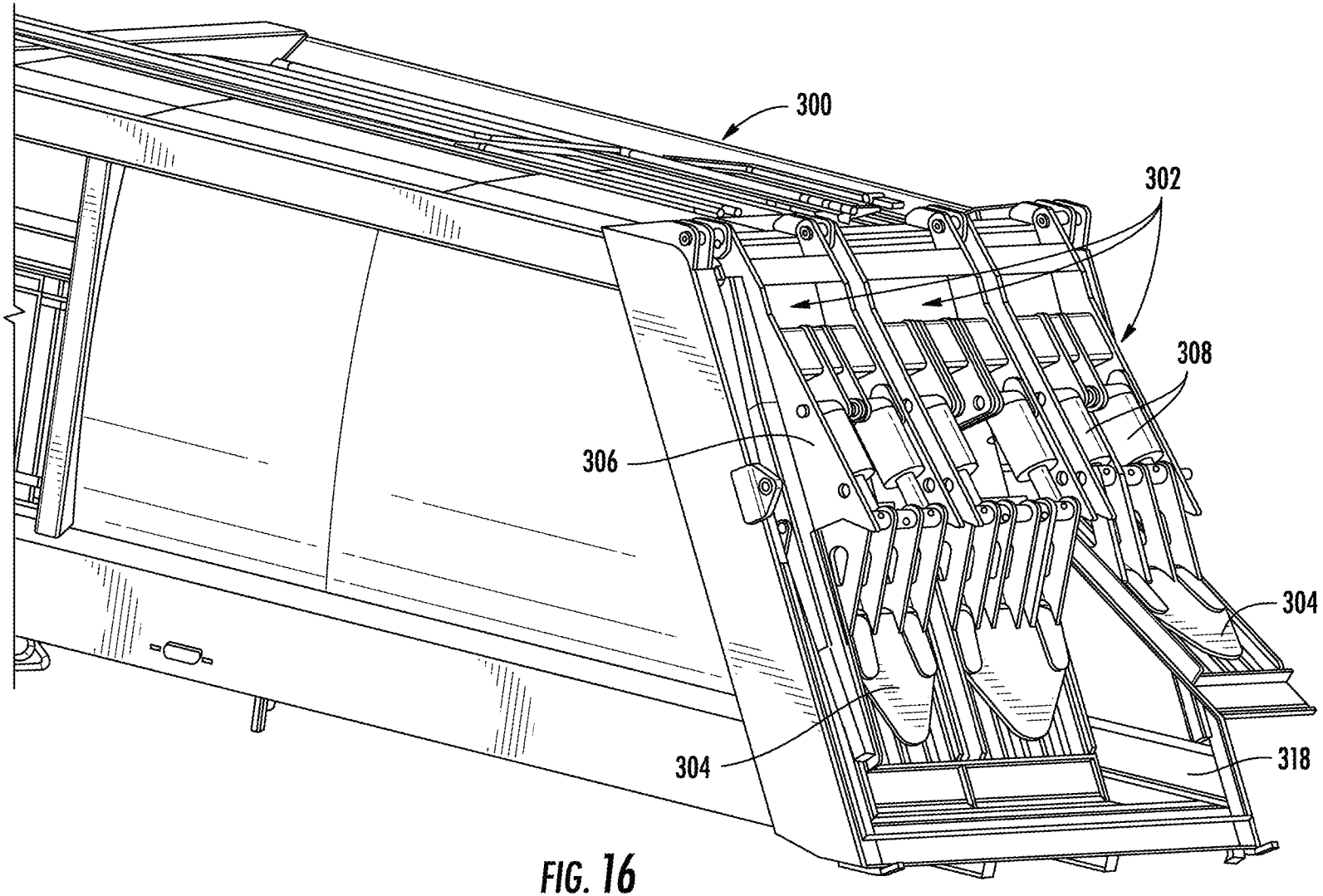
FIG. 16 is an oblique rear view of a garbage truck with three refuse compartments each equipped with an alternative embodiment of composite shields according to aspects of the disclosure.

FIGS. 16-19 illustrate an alternative embodiment of a refuse truck body 300, incorporating a composite shield 302 for each refuse compartment. Including shields for each compartment allows the operator to determine the sequence in which the compartments are offloaded. This allows the operator to adapt the offloading operation to the configuration of different refuse collection facilities. The operator controls discharge of refuse from each compartment by unlatching the shields 302 for the compartment to be emptied, while the other shields 302 remain in the closed, latched position. In FIG. 16, the lower shield segment 304, of the shield 302 corresponding to the right hand refuse compartment 318 is in the open, unlatched position. A control system as discussed above with respect to FIGS. 5-15 will detect the unlatched position of the lower shield segment 304 and/or detect a hydraulic pressure in the actuators 308 for the lower shield segment 304 corresponding to the unlatched position, and enable operation of the ejector for the right-hand refuse compartment 318. FIG. 17 is a side sectional view of the truck body 300 and composite shields 302 of FIG. 16, showing an alternative embodiment of a latch according to aspects of the disclosure. As shown in FIGS. 17-19, a latch includes a U-shaped arm 310 fixedly secured to a pin 314 extending through the hinged connection 316 between the upper end of the lower shield segment 304 and the lower end of the upper shield segment 306. The U-shaped arm 310 is rigidly attached to the lower shield segment 304 and rotates with the lower shield segment 304. As best shown in FIGS. 18 and 19, a stud 312 is fixedly attached to both inside surfaces of the compartment opening. When the lower shield segment is in the angulated (open) position shown in FIGS. 16-18, the U-shaped arm 310 does not engage the stud 312 and the shield 302 is unlatched from the truck body 300. When unlatched from the truck body 300, the shield 302 is free to pivot at an upper hinged connection 322 in response to pressure from refuse being discharged from the compartment by an ejector. FIG. 19 shows that the U-shaped arm 310 is engaged with the stud 312 when the lower shield segment 304 is in the closed position. When the lower shield segment 304 is in the closed position, the shield 302 is latched to the truck body 300. The shields of FIGS. 16-19 function in the same manner as described above, with the exception of the configuration of the latch 310/312.

We claim:

1. A refuse truck body comprising:

a main compartment and at least one side compartment, with each compartment having a rear opening extending from a roof edge to a floor edge at a rear of the truck body;

a respective pushing device for discharging refuse from each compartment;

a congruent elongated shield for the opening of the at least one side compartment, wherein the shield is connected to the truck body;

a first power source configured to move the shield to an open position;

a refuse packing unit pivotally connected to the truck body, between a packing position and an unloading position, wherein the shield is movable between the truck body and the packing unit; and a sequencing system operatively connected between the pushing device and the packing unit, that prevents the pushing device from discharging refuse from a particular side compartment unless the packing unit is in the unloading position;

wherein the shield comprises a rigid upper segment having a top end that is hinged at the edge of the roof with a first hinge and a rigid lower segment that is hinged to the upper segment with a second hinge, and where the first power source is connected to the rigid upper segment.

2. The refuse truck body of claim 1, wherein the body has a center compartment and two side compartments with a shield associated with each side compartment;

each shield is pivotally connected to the body;

when open, the pushing device pushes refuse out the rear openings, and when closed the shields prevent refuse from passing through the rear opening.

3. The refuse truck body of claim 2, wherein each opening extends from a roof edge of the truck body to a floor edge of the truck body, and wherein each shield comprises:

a rigid upper segment having a top end that is hinged at the edge of the roof with a first hinge having a first pivot joint whereby the upper segment can angulate toward and away from the opening, and an opposite bottom end;

a rigid lower segment that is hinged to the upper segment with a second hinge, having a top end confronting the bottom end of the upper segment as a second pivot joint, and extending to a bottom end at the edge of the floor;

a second power source configured for selectively pivoting the second joint between at least two positions including:

a first position having a first angle of articulation corresponding to a first mode of operation whereby the upper segment covers an upper region of the compartment opening and the lower segment covers a lower region of the compartment opening such that the shield covers the entire opening of the side compartment; and a second position having a second angle of articulation corresponding to a second mode of operation whereby the upper segment covers the upper region of the compartment opening and the bottom end of the lower segment is positioned above the edge of the floor, such that refuse can be swept over the edge of the floor into the compartment through the lower opening of the compartment, beneath the lower segment.

4. The truck body of claim 3, including a refuse packing unit pivotally connected to the truck body, between a packing position corresponding to said second mode of operation and an unloading position corresponding to a third mode of operation; and in the second mode of operation, each shield is in the second position with the packing unit holding the upper segment against the body while the lower segments of the shields are angulated upwardly;

in the third mode of operation the shield pivots via the first power source at the first hinge;

the second power source of power is carried on the upper segment and is mechanically coupled to the second hinge member at the bottom end of the upper segment;

through said coupling at the bottom end of the upper segment, the second power source angulates the lower section in selectively first or second positions relative to the upper segment, with the second position angulated to a greater degree than the first position.

5. The truck body of claim 4, wherein the coupling is a rod extending longitudinally in a direction between the top and bottom of the upper segment.

6. The truck body of claim 4, wherein the second power source is carried on the upper segment and is mechanically coupled to the second hinge member at the bottom end of the upper segment;

through said coupling at the bottom end of the upper segment, the second power source angulates the lower section in selectively first or second positions relative to the upper segment, with the second position angulated to a greater degree than the first position.

7. The truck body of claim 3, wherein a sensor is provided on the shield and is operatively connected to the sequencing system, for generating a signal indicative of whether the lower segment is in the first or second position whereby the pushing device is activatable only when the lower segment is in the second position.

8. The truck body of claim 7, wherein the second hinge member is fixed at the top end of the lower segment and an actuator is mounted on the upper segment with a drive connection to the second hinge member.

9. The truck body of claim 3, wherein the sequencing system is controlled hydraulically by hydraulic sequence valves in cooperation with hydraulic actuators for each lower shield segment.

10. The truck body of claim 3, wherein the sequencing system is controlled electronically via a control box including a microcontroller.

11. The truck body of claim 2, wherein each shield is capable of mechanically coupling to the packing unit so that raising the packing unit also raises the mechanically coupled shield.

12. The truck body of claim 1, wherein the first power source moves the shield to a fully open position so that refuse is discharged from the compartment.

13. A method of operating a multi-compartment rear load refuse packer including truck body defining a main compartment and at least one side compartment, with each compartment having a rear opening extending from a roof edge to a floor edge at a rear of the truck body, a packing unit pivotally connected to the truck body, a respective pushing device for discharging refuse from the compartment, and a congruent elongated shield for the opening of each side compartment, wherein the method comprises:

with the packing unit in a packing position, configuring the shield in a fixed position whereby an operator deposits refuse in the packing unit and the packing unit packs the deposited refuse under the shield and into the compartment;

with the packing unit in an unloading position pivoted away from the compartments and the shields moved, via a power source, to an open position relative to the compartments, a pushing device within the body discharges compacted refuse out of the compartments;

in dependence on a sequencing logic system connected between the pushing device and the packing unit, actuating operation of the pushing device only if the packing unit is in the unloading position.

14. The method of claim 13, wherein the sequencing logic system requires that shield is closed before the packing unit can be raised at the pivot.

15. A refuse truck body comprising:

a main compartment and at least one side compartment, with each compartment having a rear opening extending from a roof edge to a floor edge at a rear of the truck body;

a respective pushing device for discharging refuse from each compartment;

a congruent elongated shield for the opening of the at least one side compartment, wherein the shield is connected to the truck body;

a first power source configured to move the shield to an open position;

a refuse packing unit pivotally connected to the truck body, between a packing position and an unloading position, wherein the shield is movable between the truck body and the packing unit; and a sequencing system configured to prevent the pushing device from discharging refuse from a particular side compartment unless the shield for said particular side compartment is in the open position;

wherein the shield comprises a rigid upper segment having a top end that is hinged at the edge of the roof with a first hinge and a rigid lower segment that is hinged to the upper segment with a second hinge, and where the first power source is connected to the rigid upper segment.

* * * * *